US009427095B2

(12) United States Patent
Bird et al.

(10) Patent No.: US 9,427,095 B2
(45) Date of Patent: Aug. 30, 2016

(54) ANTI-TIP GUIDE FOR PRODUCT MERCHANDISER

(71) Applicants: Gregory M. Bird, Solon, OH (US); Gerald Matthew Szpak, Brecksville, OH (US); Shane Obitts, Elyria, OH (US); Michael Eric Liedtke, Kent, OH (US)

(72) Inventors: Gregory M. Bird, Solon, OH (US); Gerald Matthew Szpak, Brecksville, OH (US); Shane Obitts, Elyria, OH (US); Michael Eric Liedtke, Kent, OH (US)

(73) Assignee: Fasteners For Retail, Inc., Twinsburg, OH (US)

( * ) Notice: Subject to any disclaimer, the term of this patent is extended or adjusted under 35 U.S.C. 154(b) by 84 days.

(21) Appl. No.: 14/181,203

(22) Filed: Feb. 14, 2014

(65) Prior Publication Data

US 2014/0299559 A1 Oct. 9, 2014

Related U.S. Application Data

(60) Provisional application No. 61/808,014, filed on Apr. 3, 2013.

(51) Int. Cl.
*A47F 1/04* (2006.01)
*A47F 5/00* (2006.01)

(52) U.S. Cl.
CPC *A47F 1/04* (2013.01); *A47F 5/005* (2013.01)

(58) Field of Classification Search
CPC ..... A47F 1/04; A47F 3/02; A47F 7/285; A47F 1/12; A47F 5/005
USPC ..... 211/59.2–59.4, 184; 221/311, 307, 310; 108/108
See application file for complete search history.

(56) References Cited

U.S. PATENT DOCUMENTS

| | | | | |
|---|---|---|---|---|
| 2,116,386 | A * | 5/1938 | Copeland | A47F 7/143 211/120 |
| 2,572,090 | A * | 10/1951 | Durwood | 211/49.1 |
| 4,395,955 | A * | 8/1983 | Pfeifer | 108/61 |
| 4,785,943 | A * | 11/1988 | Deffner et al. | 211/59.2 |
| 5,205,421 | A * | 4/1993 | Bustos | 211/59.2 |
| D337,674 | S * | 7/1993 | Ozawa | D6/675 |
| 5,232,102 | A * | 8/1993 | Ozawa | 211/49.1 |

(Continued)

FOREIGN PATENT DOCUMENTS

DE 102012203789 A1 * 9/2013 ..... F16C 27/04

OTHER PUBLICATIONS

FFR-DSI Total Retail Solutions—2013 Yellow Pages Product Catalog, cover page, pp. 141-149.

*Primary Examiner* — Joshua J Michener
*Assistant Examiner* — Devin Barnett
(74) *Attorney, Agent, or Firm* — Fay Sharpe LLP

(57) ABSTRACT

An anti-tip guide for a merchandising shelf including an associated support member for supporting at least one associated object for display and/or dispensing, and a pair of associated dividers mounted to the support member and spaced from each other. The pair of spaced dividers define between them a longitudinal pathway along which the associated at least one object can travel from a rear position to a front position on the associated support member. The anti-tip guide includes a first section mounted to one of the pair of associated dividers and extending along a plane of the one of the pair of associated dividers. A second section of the anti-tip guide protrudes away from the first section. A third section extends from the second section. At least one of the second and third sections includes a material which is more resilient than is a material of the first section.

11 Claims, 20 Drawing Sheets

(56) References Cited

U.S. PATENT DOCUMENTS 5,570,811 A * 11/1996 Wittern et al. ..... 221/127
5,657,922 A * 8/1997 Lowery ..... B21D 5/01 228/144
6,253,954 B1 * 7/2001 Yasaka ..... 221/93
D453,534 S 2/2002 Kosir
7,690,519 B2 * 4/2010 Kahl et al. ..... 211/59.2
7,743,932 B2 * 6/2010 Lynch ..... 211/184
2003/0160060 A1 * 8/2003 Hornblad et al. ..... 221/256
2004/0020877 A1 * 2/2004 Boron ..... 211/59.2
2004/0250436 A1 * 12/2004 McAdam ..... B21D 5/042 33/534
2005/0127014 A1 * 6/2005 Richter et al. ..... 211/59.2
2005/0189310 A1 * 9/2005 Richter et al. ..... 211/59.3
2005/0218094 A1 * 10/2005 Howerton et al. ..... 211/59.3
2005/0279722 A1 * 12/2005 Ali ..... 211/59.3
2006/0196840 A1 * 9/2006 Jay et al. ..... 211/59.2
2006/0237384 A1 * 10/2006 Neumann et al. ..... 211/184
2007/0119799 A1 * 5/2007 Hanretty et al. ..... 211/59.2
2007/0256992 A1 * 11/2007 Olson ..... 211/59.3
2007/0267364 A1 * 11/2007 Barkdoll ..... 211/59.3
2007/0267366 A1 * 11/2007 Howerton et al. ..... 211/59.3
2008/0011696 A1 * 1/2008 Richter et al. ..... 211/59.2
2008/0121595 A1 * 5/2008 Trulaske ..... 211/59.2
2009/0101606 A1 * 4/2009 Olson ..... 211/59.3
2009/0236491 A1 * 9/2009 Rizzo ..... 248/623
2009/0277924 A1 * 11/2009 Kottke et al. ..... 221/279
2010/0050134 A1 * 2/2010 Clarkson ..... 715/863
2011/0089125 A1 * 4/2011 Roeske ..... 211/59.2
2011/0147323 A1 * 6/2011 Sainato et al. ..... 211/59.2
2011/0163113 A1 * 7/2011 Grubbs et al. ..... 221/311
2012/0091090 A1 * 4/2012 Larsen et al. ..... 211/184
2012/0103922 A1 * 5/2012 Bird et al. ..... 211/59.3
2012/0137614 A1 * 6/2012 Wendt ..... E04B 9/30 52/506.07
2012/0261367 A1 * 10/2012 Kabakci ..... 211/59.2
2013/0075352 A1 * 3/2013 Mitten et al. ..... 211/59.2
2013/0213779 A1 * 8/2013 Borgwardt ..... H01H 71/08 200/275
2014/0034590 A1 * 2/2014 Szpak et al. ..... 211/59.2
2014/0034591 A1 * 2/2014 Szpak et al. ..... 211/59.2
2014/0049851 A1 * 2/2014 Snell et al. ..... 359/871
2014/0190917 A1 * 7/2014 Szpak et al. ..... 211/134
2014/0299559 A1 * 10/2014 Bird et al. ..... 211/59.2
2014/0323012 A1 * 10/2014 Sopinsky et al. ..... 446/330
2014/0332482 A1 * 11/2014 Hardy ..... 211/59.3
2014/0338647 A1 * 11/2014 Cummings ..... 124/20.3
2015/0041418 A1 * 2/2015 Grubbs et al. ..... 211/59.3
2015/0053631 A1 * 2/2015 Hardy ..... 211/59.3

* cited by examiner

ANTI-TIP GUIDE FOR PRODUCT MERCHANDISER

This application claims the benefit of Provisional Application Ser. No. 61/808,014 which was filed on Apr. 3, 2013. The entire content of that application is incorporated hereinto by reference.

BACKGROUND

The present development concerns a product dispensing system employed in point of sale merchandising.

The present disclosure relates particularly to shelving systems for feeding containers forward. More specifically, it relates to modular gravity fed shelving systems for fragile products, such as individual thin wall containers of a dairy product, such as yogurt. Yogurt is typically sold in individual cups or containers in supermarkets and the like. Traditionally, yogurt is sold in refrigerator cases including generally horizontal shelves upon which the yogurt containers, having planar bases and planar tops, are stacked. The yogurt or other refrigerated product can be displayed on generally horizontal shelves on which a customer needs to pull the product forward if the product is not at the front end of the shelf. Alternatively, such products can be displayed on somewhat downwardly slanted shelves which feed product forward by gravity. It should also be appreciated that pusher assemblies could be employed to urge dairy product containers such as yogurt, cream cheese, butter or sour cream containers or tubs forward on a shelf. Many such containers have planar bases and planar tops so that they can be stacked two or three high on a merchandising shelf.

Gravity feed systems are known to move products towards the front of display or storage cases. While it is now known to gravity feed yogurt towards the front end of a refrigerated display case, the currently known retainers positioned at the front end of such yogurt display trays or shelves are not optimal. More specifically, it is known to provide flexible fingers or tabs attached to each side wall or divider wall of a channel defined in the tray. These fingers or tabs are not particularly sturdy and may become damaged. Replacement of the fingers, tabs or arms may necessitate replacing the divider wall itself, since these elements are generally fastened to the dividing wall. Stacked product on the shelf may tip during either removal or restocking of the product, which is disadvantageous.

One difficulty with current merchandising systems in which several containers are stacked atop each other on a merchandising shelf is that the containers can become canted or tilted on the shelf. This impedes access to one or more containers of product and may dissuade a potential consumer from purchasing product on that shelf. Thus, a need exists for a shelving system which would reduce the tendency of products on an upper level of a stack of products to tip in relation to the subjacent layer of products supporting them.

BRIEF DESCRIPTION OF THE DISCLOSURE

An anti-tip guide for a merchandising shelf includes an associated support member for supporting at least one associated object for display and/or dispensing and a pair of associated dividers mounted to the support member and spaced from each other. The pair of spaced dividers define between them a longitudinal pathway along which the associated at least one object can travel from a rear position to a front position on the associated support member. The anti-tip guide includes a first section mounted to one of the pair of associated dividers and extending a plane oriented parallel to a plane of the one of the pair of associated dividers, and a second section connected to and protruding away from the plane of the first section. The second section comprises a material which is more resilient than is a material of the first section.

According to another embodiment of the present disclosure, a merchandising assembly comprises a support member for supporting at least one associated object for display and/or dispensing, a first divider mounted to the support member, and the second divider mounted to the support member in spaced relation to the first divider. The first and second dividers define between them a longitudinal pathway along which the at least one the associated object can travel from the rear position to a front position on the support member. An anti-tip guide is mounted to one of the first and second dividers. The anti-tip guide comprises a first section extending in a plane parallel to a plane of the one of the first and second dividers, a second section connected to and extending away from the plane on the first section at an acute angle and a third section connected to and extending away from the second section. At least one of the second and third sections comprises a material which is more resilient than is a material of the first section.

BRIEF DESCRIPTION OF THE DRAWINGS

The present invention may take physical form in certain parts and arrangements of parts, several embodiments of which will be described in detail in this specification and illustrated in the accompanying drawings which form a part hereof and wherein.

DETAILED DESCRIPTION

It should be understood that the description and drawings herein are merely illustrative and that various modifications and changes can be made in the structures disclosed, without departing from the scope of the present disclosure. It should also be appreciated that the various identified components of the product merchandising system discussed herein are merely terms of art and that these may vary from one manufacturer to another. Such terms should not be deemed to limit the present disclosure.

Figure 1:
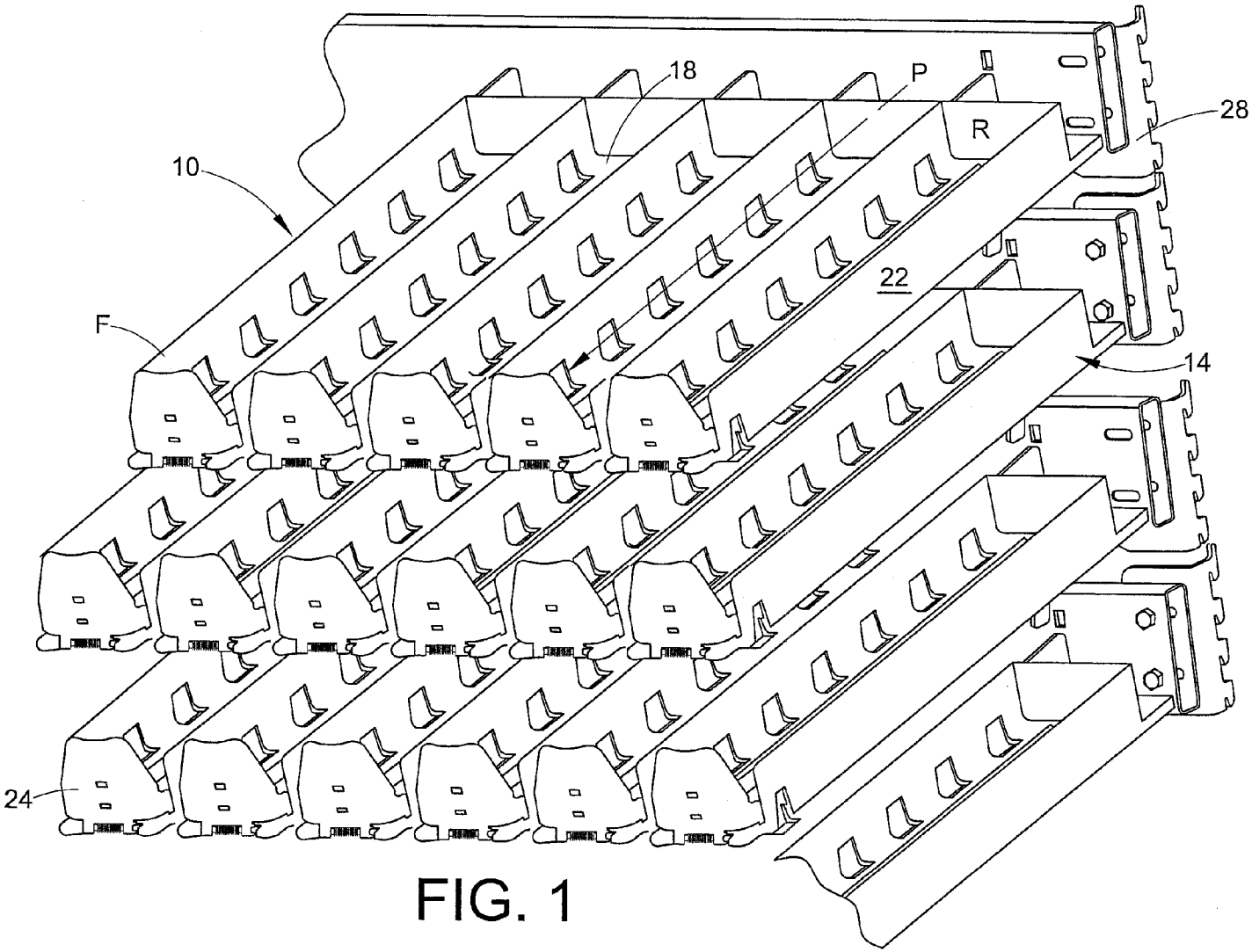
FIG. 1 a perspective view of a product merchandiser system according to one embodiment of the present disclosure.

With reference now to FIG. 1, a first embodiment of the disclosure includes a plurality of merchandising shelves or trays 10 arranged in a two-dimensional array. Each merchandising shelf 10 includes a support member 14 for supporting one or more containers, such as jars or cup-shaped objects, for example, yogurt containers 16 (FIG. 2), for display and/or dispensing. In the illustrated embodiment, the support member 14 generally includes a bottom panel 18 and a pair of laterally spaced apart sidewalls 22 defining therebetween a longitudinally extending channel that generally defines a longitudinal pathway P along which the associated objects can travel from a rear position R to a front position F of the shelf, as by a gravity feed. In another embodiment (not shown), a pusher fed design can be employed. At a leading end or front end of each support member 14, a movable retainer 24 is supported or mounted for retaining the objects within the channel. While yogurt containers are discussed specifically herein, it should be appreciated that other types of cup-shaped or jar-shaped containers such as soup, cereal, oatmeal, baby food or other food containers or other types of containers such as paint or stain containers could be merchandised in the same manner.

Figure 2:
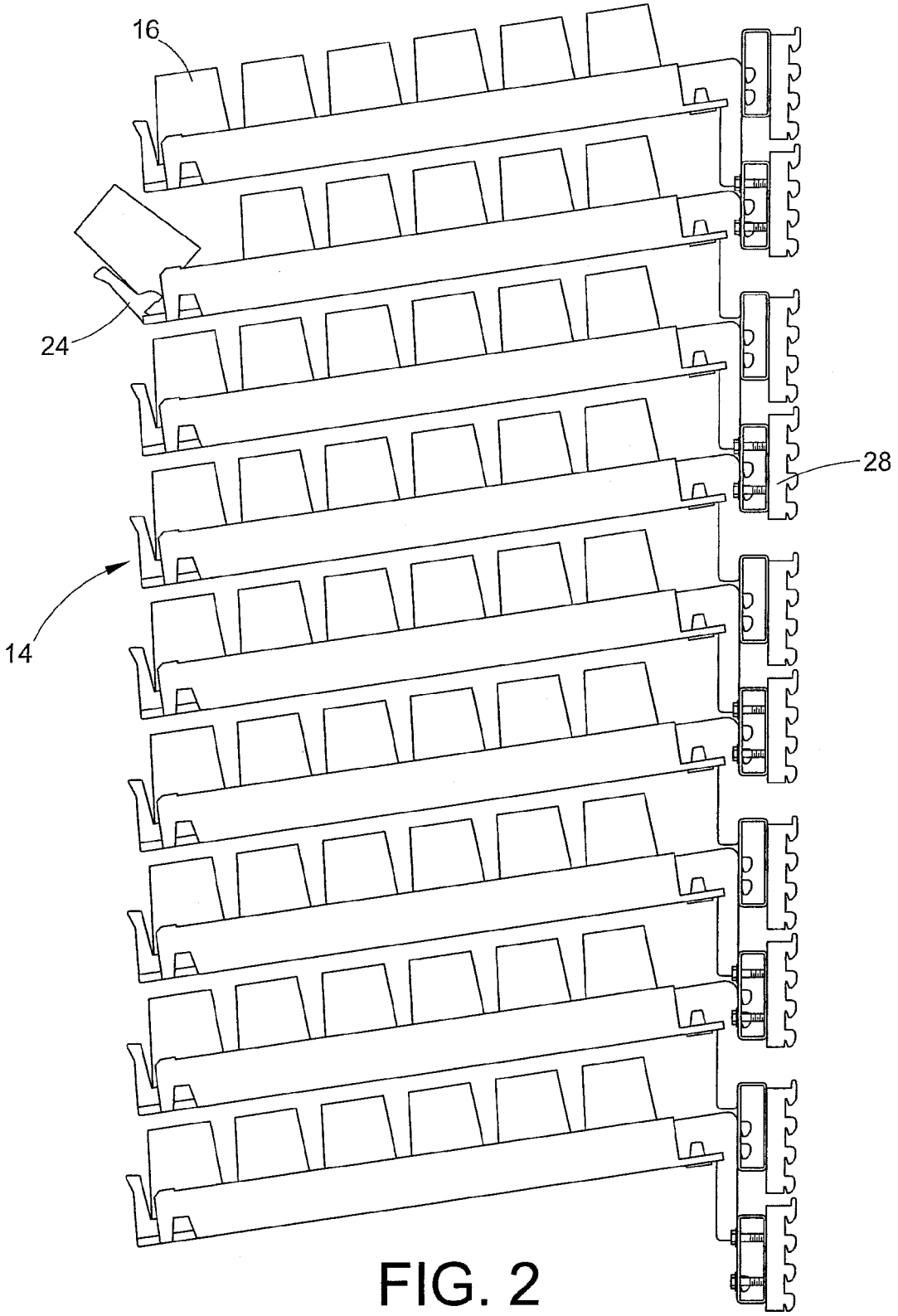
FIG. 2 is a reduced side elevational view of the product merchandiser system of FIG. 1.

With further reference to FIG. 2, it will be appreciated that the movable retainer 24 of each merchandising shelf 10 is movable between a first position, or rest position, at least partially obstructing the pathway thereby restricting forward movement of a yogurt container 16 beyond the front position F of the shelf 10 to a second position, or dispensing position, allowing further forward movement of the yogurt container 16 for removal of the yogurt container. The movable retainer 24, therefore, functions both to retain yogurt containers 16 on the merchandising shelf 10 as well as to permit selective removal of the forward-most container from a column of such containers held on the shelf, while generally restricting access to other yogurt containers on the shelf.

The merchandising shelves 10 or trays of FIGS. 1 and 2 are angled downwardly from rear to front such that the yogurt containers are fed by gravity to the front position F of the support member 14. Although not illustrated, a suitable pusher assembly, which may be spring loaded, can alternatively be provided for advancing the cup-shaped containers toward the front of the merchandising shelf 10. Such pusher assemblies are well known in the art. The merchandising shelves can be made of a suitable known material (such as a thermoplastic or thermoset material) and, in one embodiment, are provided in sets of three elongated side-by-side support members forming a tray that is secured to a common rack member 28 for mounting to rails (not shown) in a conventional manner.

Figure 3:
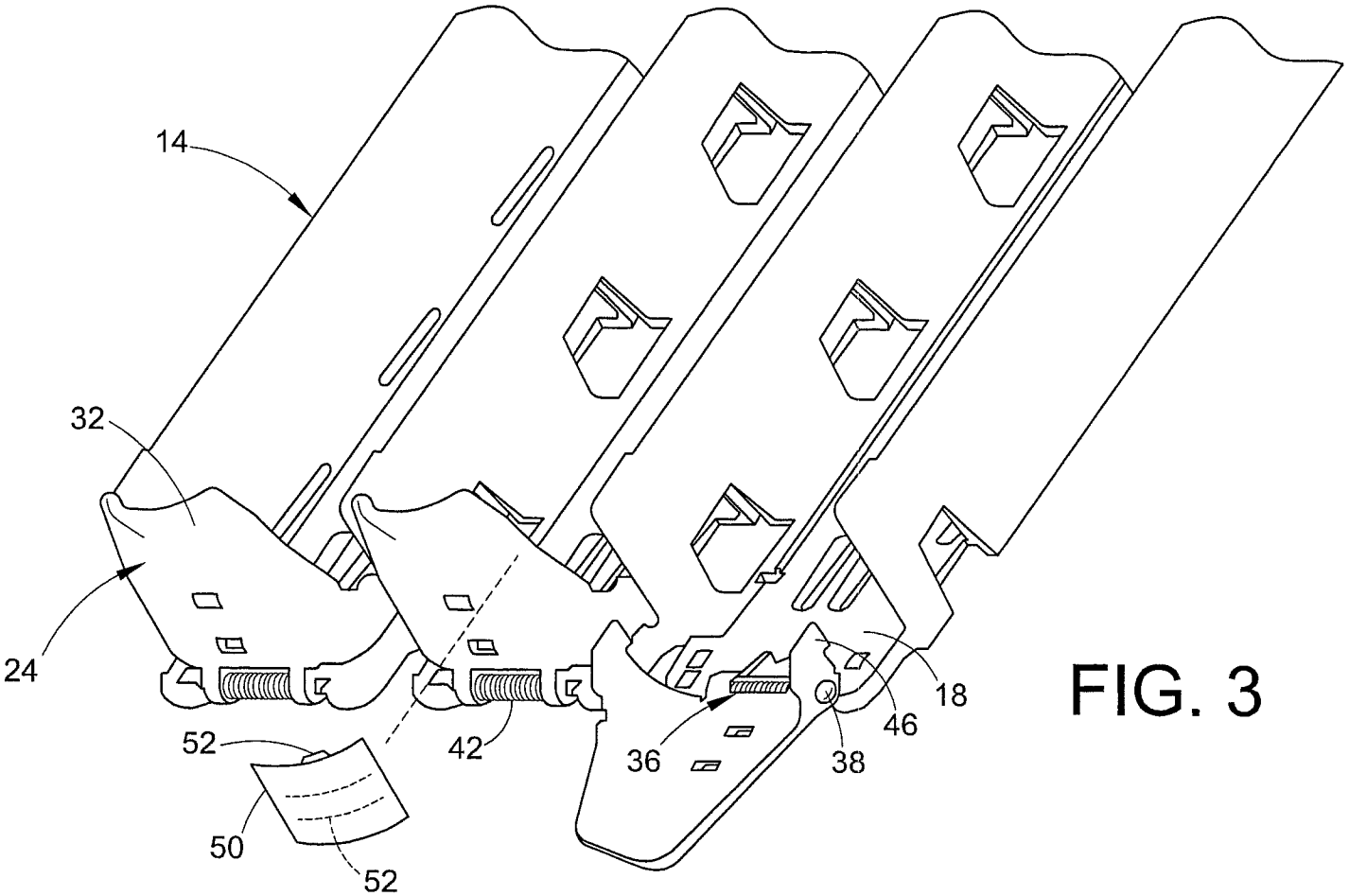
FIG. 3 is an enlarged perspective view of a portion of the product merchandiser system of FIG. 1.
Figure 4:
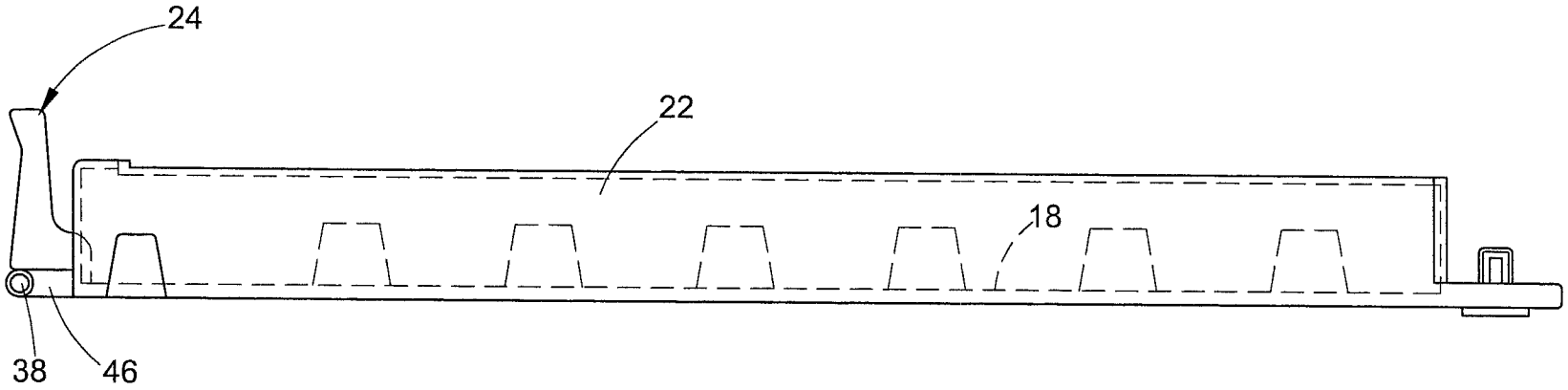
FIG. 4 is an enlarged side elevational view of a mounting channel of the product merchandiser system of FIG. 1.

Turning to FIGS. 3 and 4, the movable retainer 24 includes a panel 32 pivotally attached to the support member 14. The panel 32 is configured to pivot from an upright position (left and center merchandising shelves) corresponding to the first position at least partially obstructing the path along which the yogurt containers can travel, to a position reclined or tilted relative to the upright position (right merchandising shelf) corresponding to the second position allowing further forward movement of the yogurt containers along the pathway. In other words, the panel 32 is resiliently mounted to the support member 14. The withdrawal of the forwardmost container may involve tilting out the top portion or bottom portion of the container once the panel is moved away from its upright position. In other words, the container is rotated somewhat before it is removed. It is apparent that, in the embodiment shown, a separate panel 32 is provided for each column of containers meant to be merchandised.

In the embodiment illustrated in FIG. 3, the panel 32 is secured to the bottom panel 18 of the support member 14 by a hinge 36 comprised of a pair of pins 38 (only one of which is visible) retained in corresponding slots 40 in the bottom panel 18. The panel 32 of the movable retainer 24 is biased towards the upright position by a spring 42, such as a torsion spring installed between the panel 32 and the support member 14. The spring 42 generally maintains the panel in the upright position to prevent the product containers from spilling off the front edge of the shelf. While a particular type of spring is shown in FIG. 3, it should be appreciated that any type of spring could be employed, such as flat springs, leaf springs, and a variety of coil springs such as tension, compression, or torsion springs depending on the particular construction of the associated panel and support member.

To dispense a product container 16 from the merchandising shelf 10, a consumer will typically grasp the forward-most container and pull the container away from the shelf. As shown in FIG. 2, the additional force applied to the panel 32 by the consumer as the container is being moved away from the merchandising shelf will result in the panel deflecting to a tilted or reclined position that allows further forward movement of the container such that it clears the end of the support member 14 and/or panel 32 at which time the panel 32 returns to the upright position in order to retain the remaining containers on the support member 14 of the merchandising shelf 10. While a downward tilted or reclined position is shown in FIG. 3, the panel could be pivoted at its upper end so as to allow withdrawal of containers when the panel is tilted upwardly. Put another way, a pivotable barrier or "door" is disclosed in this embodiment, with the pivot axis being aligned with the base or bottom panel 18 of the support member 14.

In the embodiment illustrated in FIG. 3, the product facing side of the panel 32 is generally concave such that it can at least partially surround the forward most cup-shaped container. This can prevent the container 10 from rolling side to side when the panel 32 is in the tilted position (e.g., second shelf from top in FIG. 2). With reference now also to FIG. 4, in one embodiment, the generally concave shape of the panel 32 is formed by a pair of opposed arms 46 that extend rearwardly from the panel. Other configurations of the panel could be provided, as will be appreciated. Each panel can further include a tag holder 50 that can be affixed to a front facing surface of the panel for displaying pricing information and other product information. A pair of tabs 52 are provided for securing the tag holder 50 to the panel 32.

Other configurations of the movable retainer are also contemplated. For example, turning to FIG. 5, merchandising shelves 10' are shown with a movable retainer in the form of an elastomer body 60 secured at opposing ends thereof to respective side sections or anchor elements 62 of the support member 14' of each shelf 10'. In the embodiment shown, the elastomer body 60 can be tubular. Of course, other designs are also contemplated. However shaped, the body is flexible and is designed to be resiliently deformed between a first position, at least partially obstructing the pathway along which the product containers can travel to restrict forward movement of the product containers to a second position allowing further forward movement of the product containers beyond the first position.

For example, a consumer may grasp the forward-most product container and apply a force to the elastomer body through the container tending to stretch the elastomer body 60 in relation to the shelf 10'. As will be appreciated, such deflection of the elastomer body 60 results from further forward movement of the container and allows the container to be removed from its shelf. Once the container is no longer in contact with the elastomer body 60, the elastomer body 60, which retains memory, will return to its configuration illustrated in FIG. 5 whereat it will at least partially obstruct the pathway along which the remaining containers can travel to restrict forward movement of the remaining product containers along the pathway.

Figure 6:
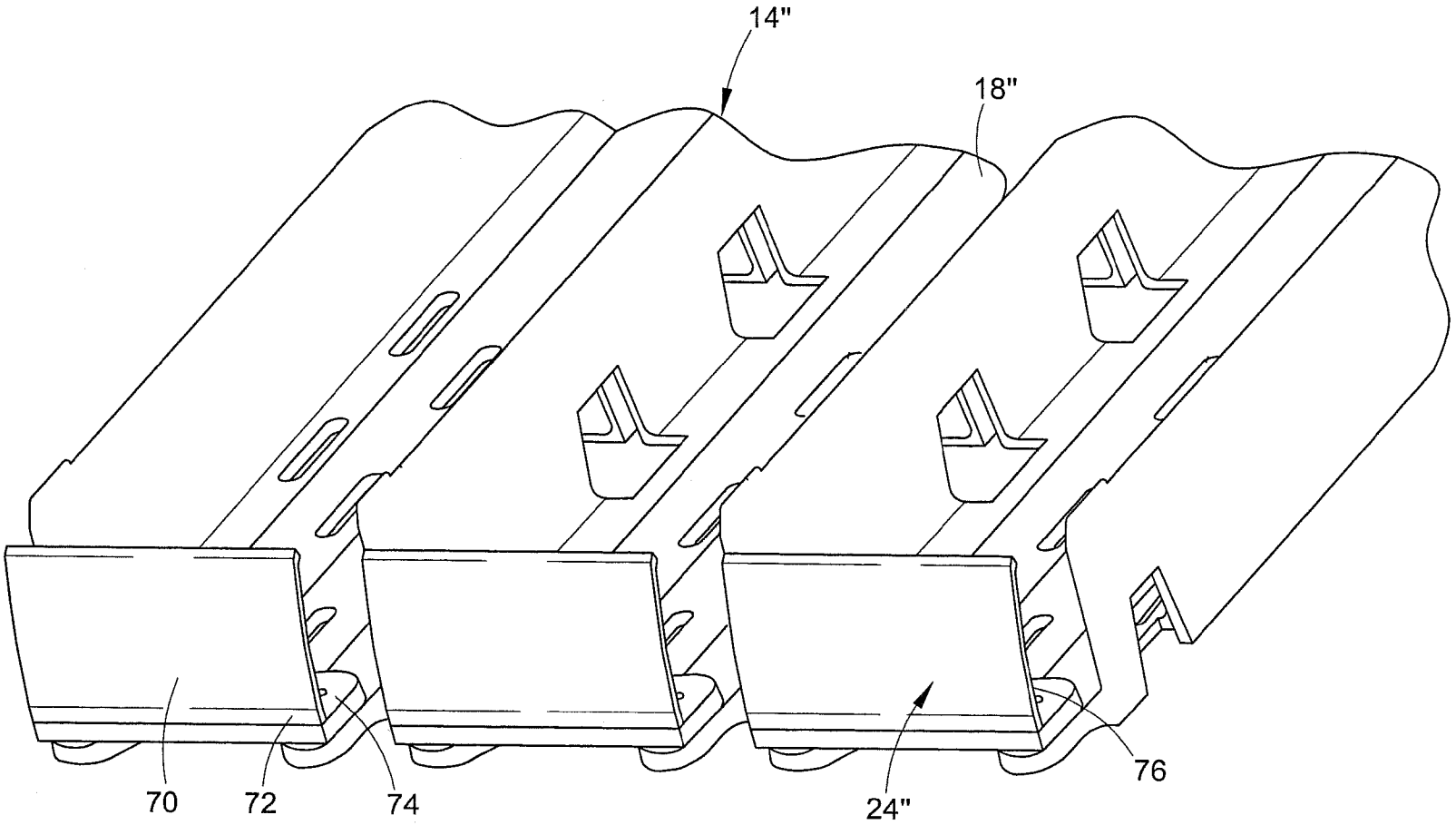
FIG. 6 is a perspective view of an exemplary product merchandiser according to still another embodiment of the disclosure including a movable retainer, including a hinge formed by a flexible web, for retaining one or more containers.

In another embodiment shown in FIG. 6, a movable retainer 24" is in the form of a panel 70 that is hingedly secured to a support member 14" via a flexible web 72 that is connected to a base 74. The flexible web 72 acts as a hinge to allow the panel 70 to flex between an upright position and a tilted position, similar to the embodiment of FIGS. 1-3. In this embodiment, the panel 70 can be formed integrally with the hinge portion/flexible web such that the panel 70, hinge 72 and base 74 can be mounted as a single unit to a base portion 18" of the support member 14" without the need to assemble a hinge separately. The hinge or flexible web 72 can be resilient such that the panel 70 is biased to the upright position as shown. In one embodiment, the retainer 24" can be made of a suitable coextruded thermoplastic material in which the hinge portion 72 is made of a softer, more resilient thermoplastic than is either the panel 70 or the base 74. It should be appreciated that the base 74 can be secured to the base portion 18" of the support member 14" by suitable fasteners 76.

Figure 7:
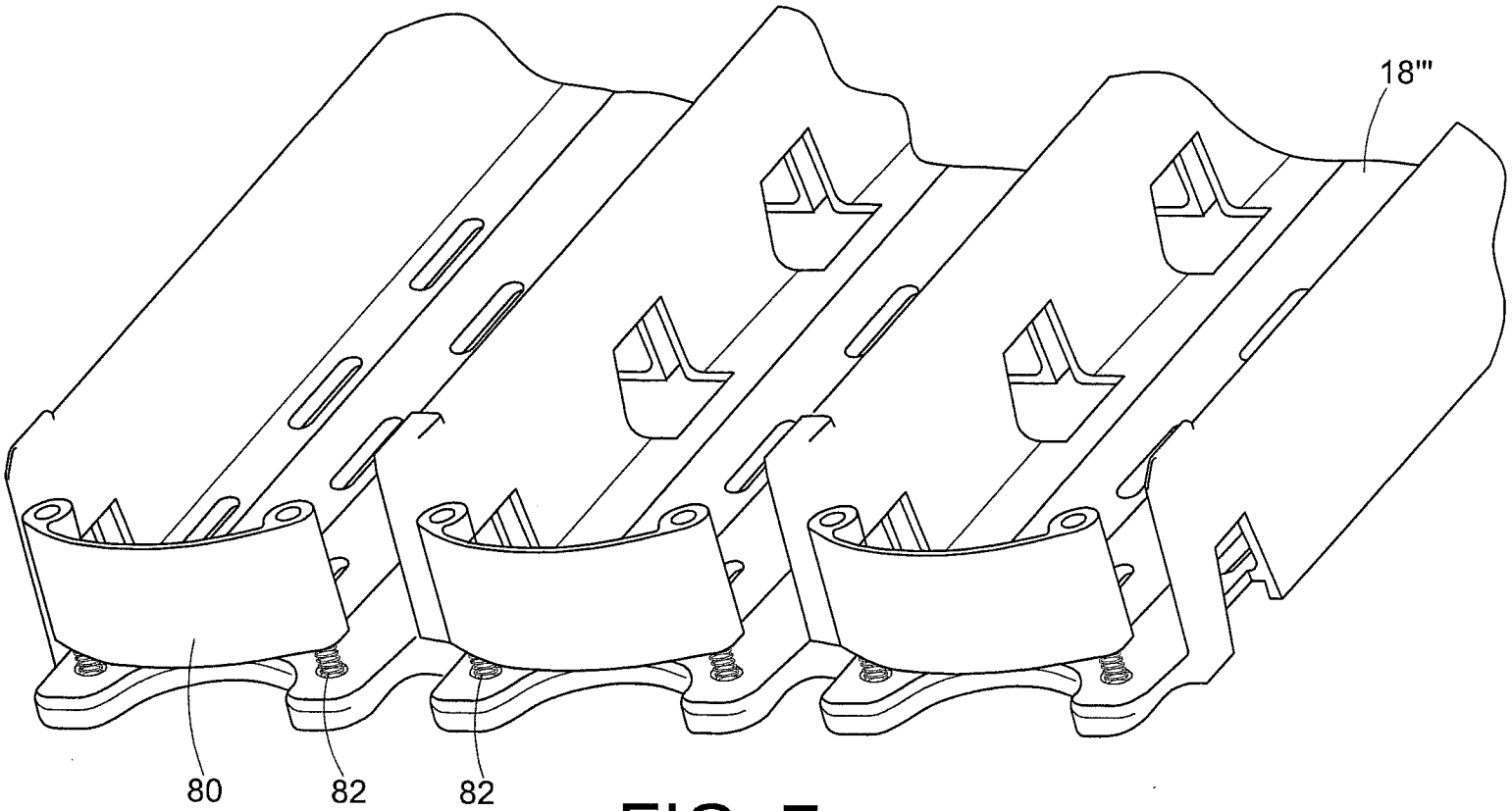
FIG. 7 is a perspective view of an exemplary product merchandiser according to a further embodiment of the present disclosure including a movable retainer mounted on vertical springs for retaining one or more containers on a tray or shelf.

Turning to FIG. 7, yet another exemplary embodiment is illustrated wherein a movable retainer 24''' is in the form of a panel 80 that is mounted to the support member 14''' by a pair of spring elements 82 extending between the panel 80 and a bottom 18''' of a support member 14'''. The spring elements 82 in the illustrated embodiment are coil springs and generally bias the panel 80 towards the upright position, but also permit deflection of the panel to a reclined position, thus serving as both a hinge connection and as a biasing mechanism. It should be appreciated that the springs 82 will resiliently bias the panel 80 to the position illustrated in FIG. 7, i.e., a position perpendicular to the bottom 18''' of the support member 14''', when the panel is moved away from that position, such as by the removal of a cup, jar or other container of product from the display tray or shelf. It should be appreciated that other types of resilient members, such as rubber tendons, can be used instead of the springs illustrated in this embodiment.

In the embodiments illustrated in FIGS. 3, 4, 6 and 7, the respective moveable retainer 24, 70 and 80 is pivotally attached along its lower end to a portion of the respective channel. Thus, the retainer pivots forwardly and allows access to the food item held in the channel.

Restocking of the tray can be accomplished by providing a tray system which can slide outwardly from the shelf, as is known in the art. Alternatively, restocking could take place by simply pivoting the barrier downwardly away from its blocking position, although this would appear to be a less desirable alternative.

Figure 8:
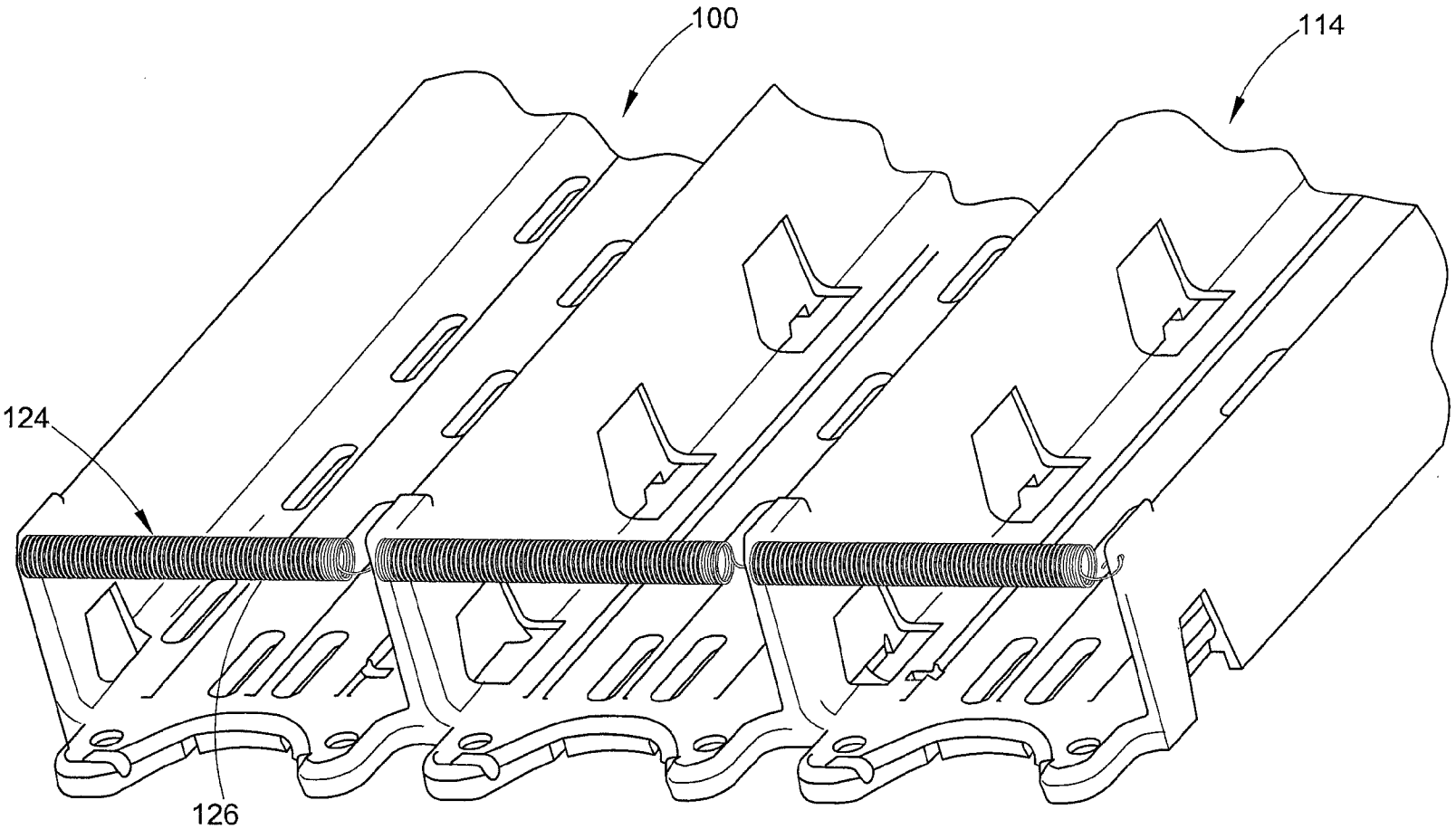
FIG. 8 is a perspective view of an exemplary product merchandiser according to yet another embodiment of the present disclosure including an exemplary spring element for retaining one or more containers.

Referring now to FIG. 8, still another exemplary embodiment of a shelf 100 including a movable retainer in accordance with the disclosure is illustrated. In this embodiment, a movable retainer 124 is in the form of a spring 126 extending transversely across the longitudinal pathway defined by a support member 114. The spring 126 is fixed at opposite ends thereof to the opposing sidewalls of the support member 114 and is configured to resiliently deflect in relation to the support member between the position illustrated in FIG. 8 for restricting forward movement of the product containers to a second position (not shown) allowing further forward movement of the front product container beyond the position illustrated for removal from the shelf 10 in a manner similar to that described in connection with previous embodiments. When pressure is no longer exerted on the spring 126, it will return to its configuration as illustrated in FIG. 8, thus preventing any other product containers from falling away from the tray or shelf 100.

FIG. 8 also illustrates an embodiment in which three columns of product, i.e., yogurt or the like, can be displayed on an integrally formed tray. It should be appreciated that the tray can display any desired number of columns of product from 1 to 10, if so desired. It should also be appreciated that the disclosed product merchandiser can be employed with multi-packs of products, such as pudding, apple sauce, Jell-O and the like.

Figure 5:
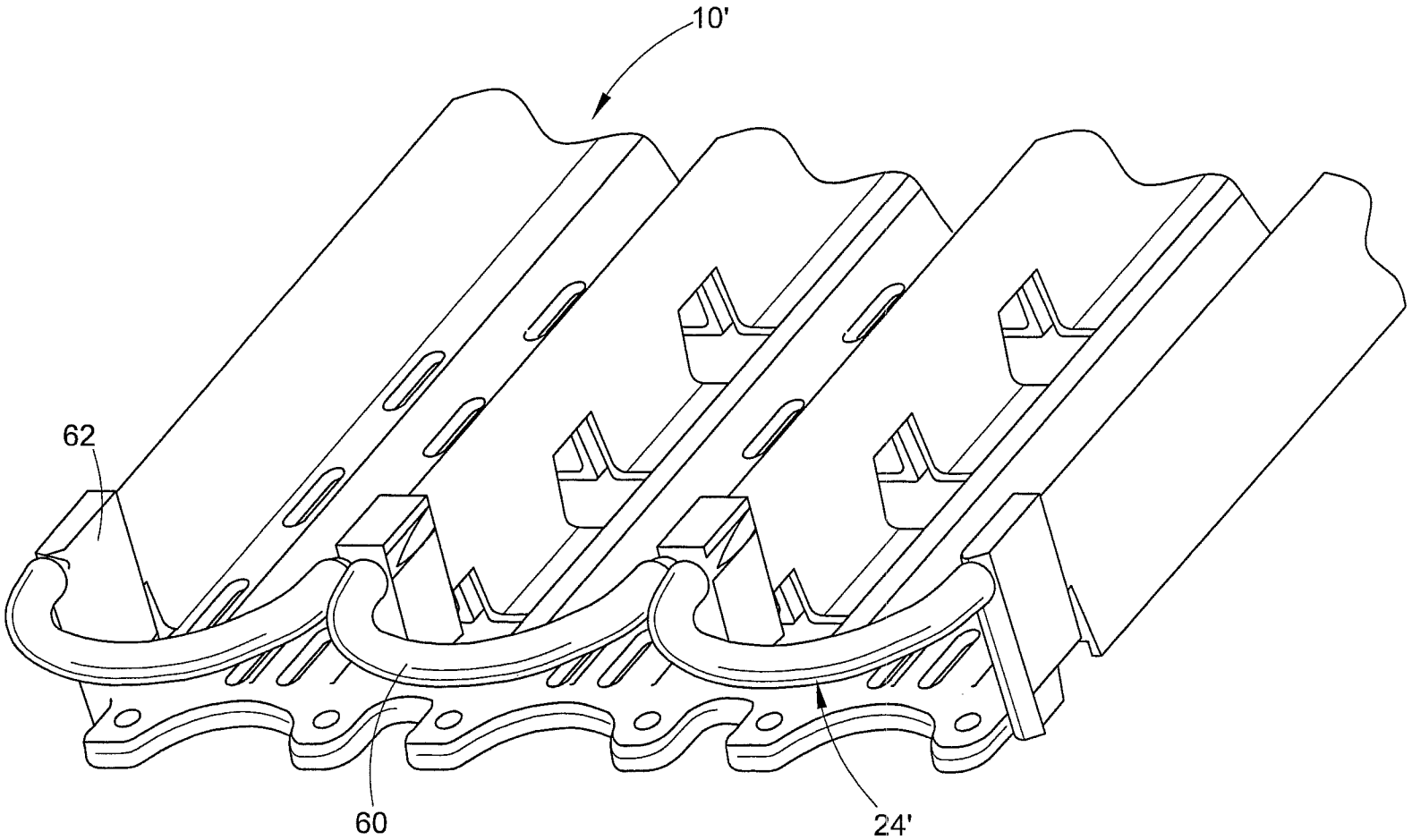
FIG. 5 is a perspective view of an exemplary product merchandiser according to another embodiment of the disclosure including elastomer bodies for retaining one or more containers on a tray or shelf.

In the embodiments illustrated in FIGS. 5 and 8, the respective movable retainers 60 and 124 are designed to flex or extend from a first position which prevents forward movement of a merchandise item located in the channel to a second extended position which allows such further movement of the merchandise product. In this way, products can be withdrawn from the channel.

Figure 9:
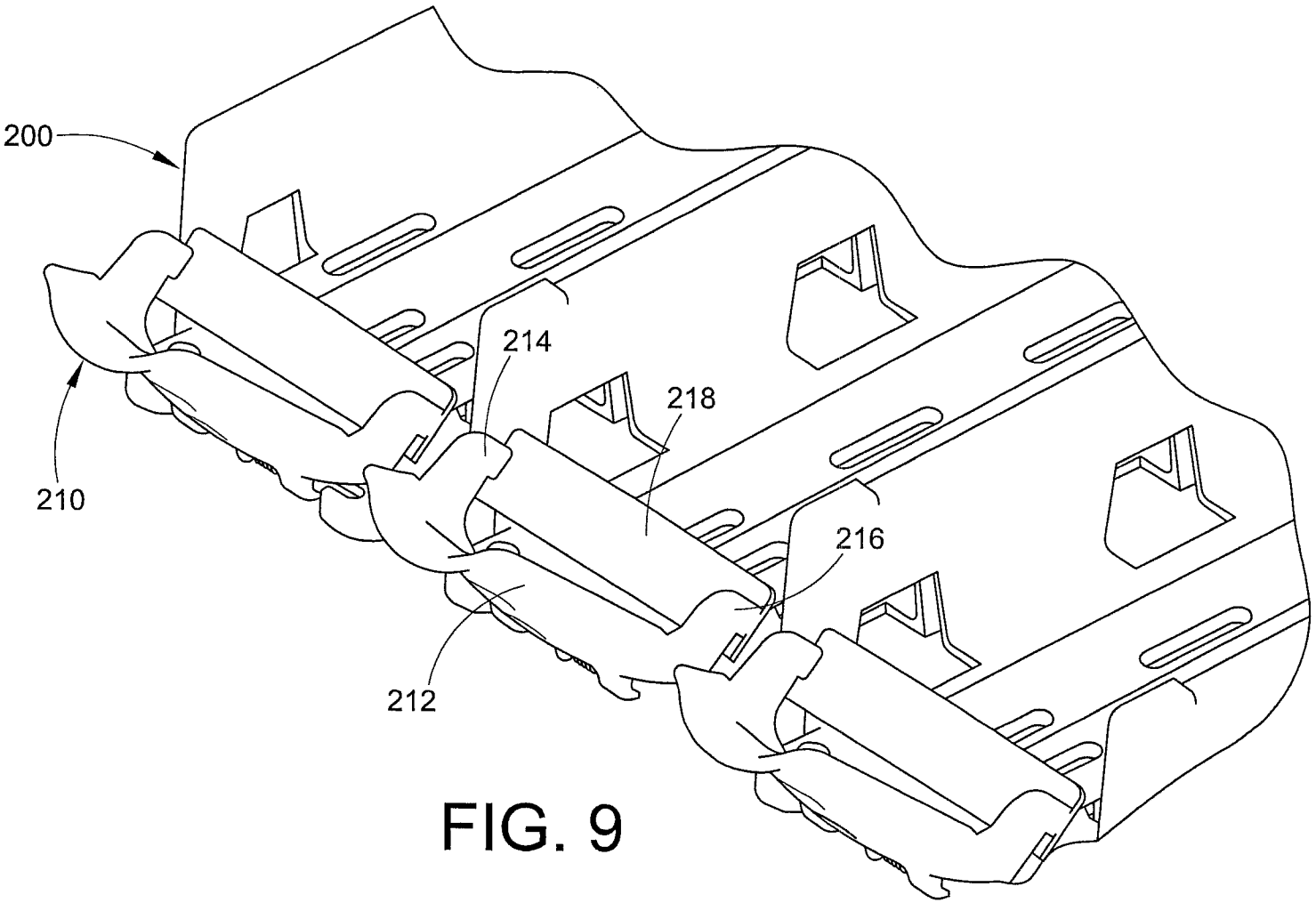
FIG. 9 is a perspective view of a yet further embodiment of a product merchandiser according to the present disclosure including a movable retainer having a bottom wall, acting as a stop member.

With reference now to FIG. 9, a further embodiment of a product merchandiser 200 is there illustrated. In this embodiment, a movable retainer 210 includes a front wall or panel 212, a pair of side walls 214 and 216, and a bottom wall 218. When the retainer 210 is moved from its rest position to a dispensing position, all of the walls move. In the dispensing position, which is illustrated in FIG. 9, the bottom wall 218 acts as a stop which prevents additional products from advancing forwardly in the column from which product is being dispensed. Such a stop is particularly important if the containers are sold in glass jars, such as is baby food. The stop is designed to prevent additional products from falling out of the shelf when one product is removed. However, when the retainer is returned to its original rest position, the containers are allowed to move forwardly on the shelf. In the embodiment disclosed, the retainer is movable between its rest position and its dispensing position via a suitable hinge (not visible). The retainer can be biased to its rest position by a biasing element (not visible). In the embodiment illustrated, the base wall 218 is fastened to the pair of side walls 214, 216 of the retainer 210. However, it should be appreciated that other constructions are also contemplated.

Figure 10:
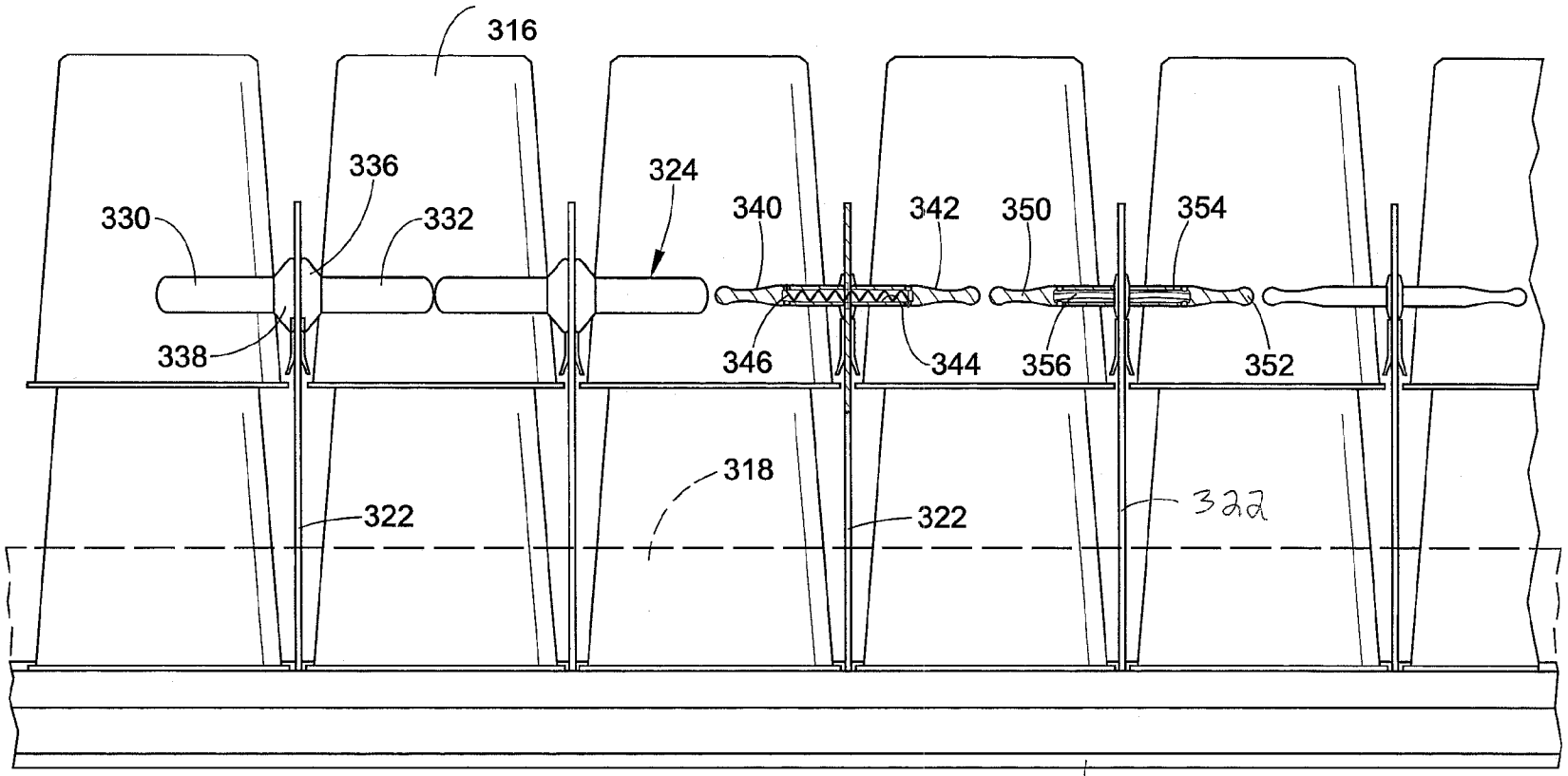
FIG. 10 is a front elevational view of a still further embodiment of a product merchandiser according to the present disclosure illustrating several different types of movable retainers.

With reference now to FIG. 10, disclosed is a shelf 310 on which are positioned a plurality of food product containers such as yogurt containers 316 stacked such that a first, lower, layer is covered by a second, upper, layer. A front fence 318 is attached to the shelf 310 and serves as a barrier to retard forward movement of the lower layer of containers. The containers are divided into columns by side walls or dividers 322. Movable retainers 324 are attached to the dividers and serve to retard forward movement of the upper layer of containers 316.

A variety of types of movable retainers are disclosed. In a first, one piece, design, a pair of retaining fingers 330 and 332 extend on the two sides of a first divider 322. The fingers, which are made of a resilient material, such as a thermoplastic, extend through either side of an aperture 336 defined in the divider. In this embodiment, a one piece retainer is disclosed which is pushed through the divider aperture 336 until one base portion 338 of the retainer is located on each side of the divider.

In another embodiment of a movable retainer, there are provided first and second fingers 340 and 342 which are connected on respective sides of a second divider 322. Defined in the first and second fingers are respective cavities 344 which can accommodate respective springs 346 which can be connected to each other. In this embodiment, the two fingers are mounted to respective sides of the second divider 322. The springs 346 allow the two fingers to move as needed in relation to the divider. In the embodiment illustrated in FIG. 10A, mounted on the divider 322 are a pair of bases 341. Each of the bases accommodates a respective finger 340 and 342. Disposed in the cavities 344 of the two fingers is a single spring 347 which extends through an aperture 348 in the divider 322.

Figure 10A:
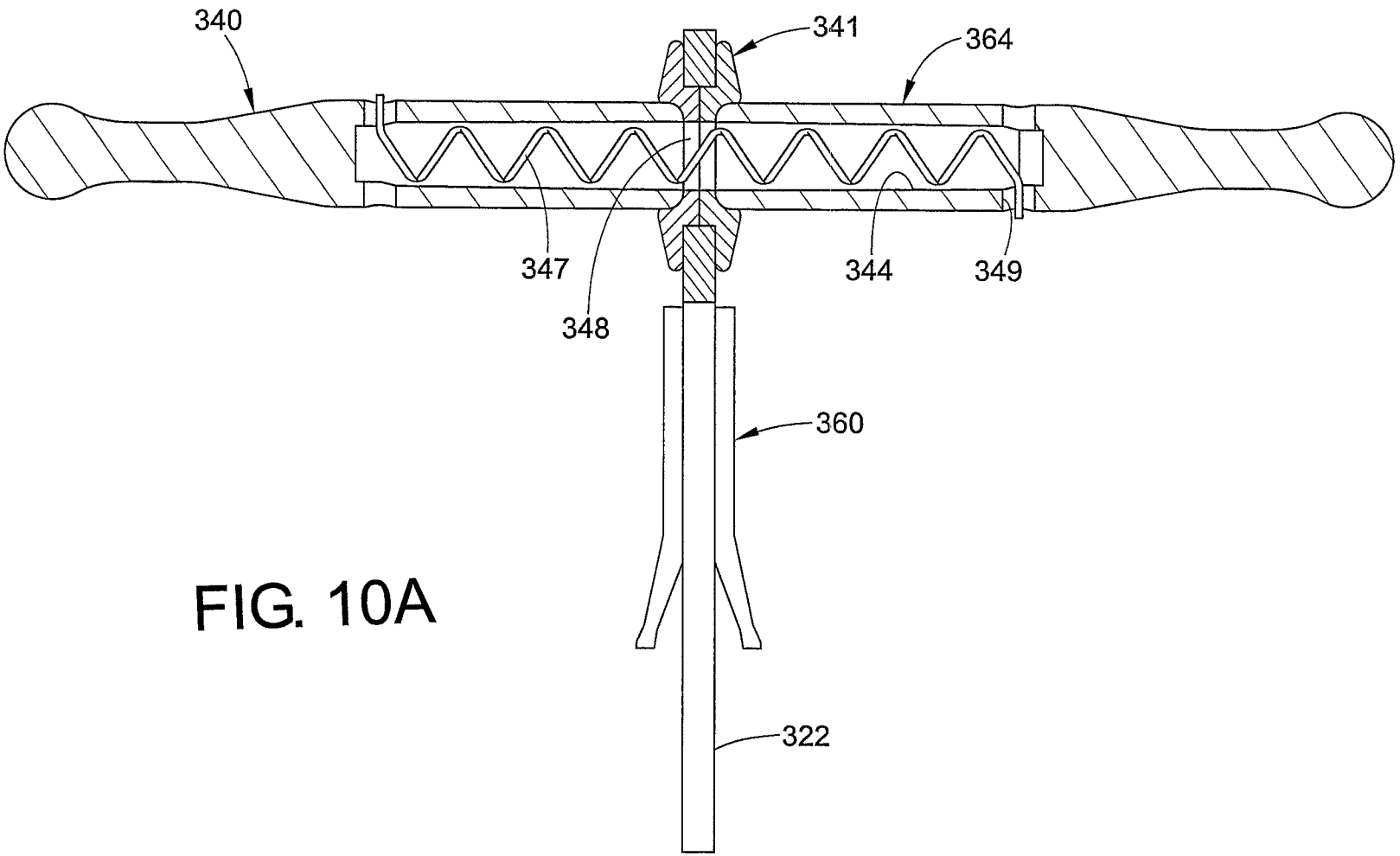
FIG. 10A is an enlarged front elevational view of a portion of the embodiment illustrated in FIG. 10.

It should be appreciated that either respective springs, such as 346 illustrated in FIG. 10, or a single spring, such as 347 illustrated in FIG. 10A can be employed in connection with the movable retainer. In one embodiment, the springs 346 or 347 are tension springs. As is apparent from FIG. 10A, the opposed ends of the spring 347 extend out or protrude through apertures 349 located in each of the fingers 340 and 342. The apertures 349 are located at the distal end of the respective cavity 344 in each of the fingers. The fingers 340 and 342 are thus free to move within the confinement of the base geometry and the tension of the springs or other resilient biasing members employed. An omnidirectional movement of the fingers 340, 342 is facilitated through the use of such biasing members. The bases 341 serve as sockets for accommodating movement of the fingers in various directions in relation to both the bases and the divider 322. Put another way, the fingers 340 and 342 can pivot forwardly and rearwardly as well as up and down in relation to the divider 322.

Also disclosed in FIG. 10 is a third embodiment of a movable retainer. In this embodiment, there are provided first and second fingers 350 and 352. These extend on opposing sides of a third divider 322. Held within respective cavities 354 of the fingers are respective elastic bands 356. These bands serve to provide flexibility to the fingers so that they can move as is needed to either dispense food containers 316 from the shelf or to restock such containers if a customer decides that, on second thought, he or she does not wish to purchase the selected container of food.

Figure 11:
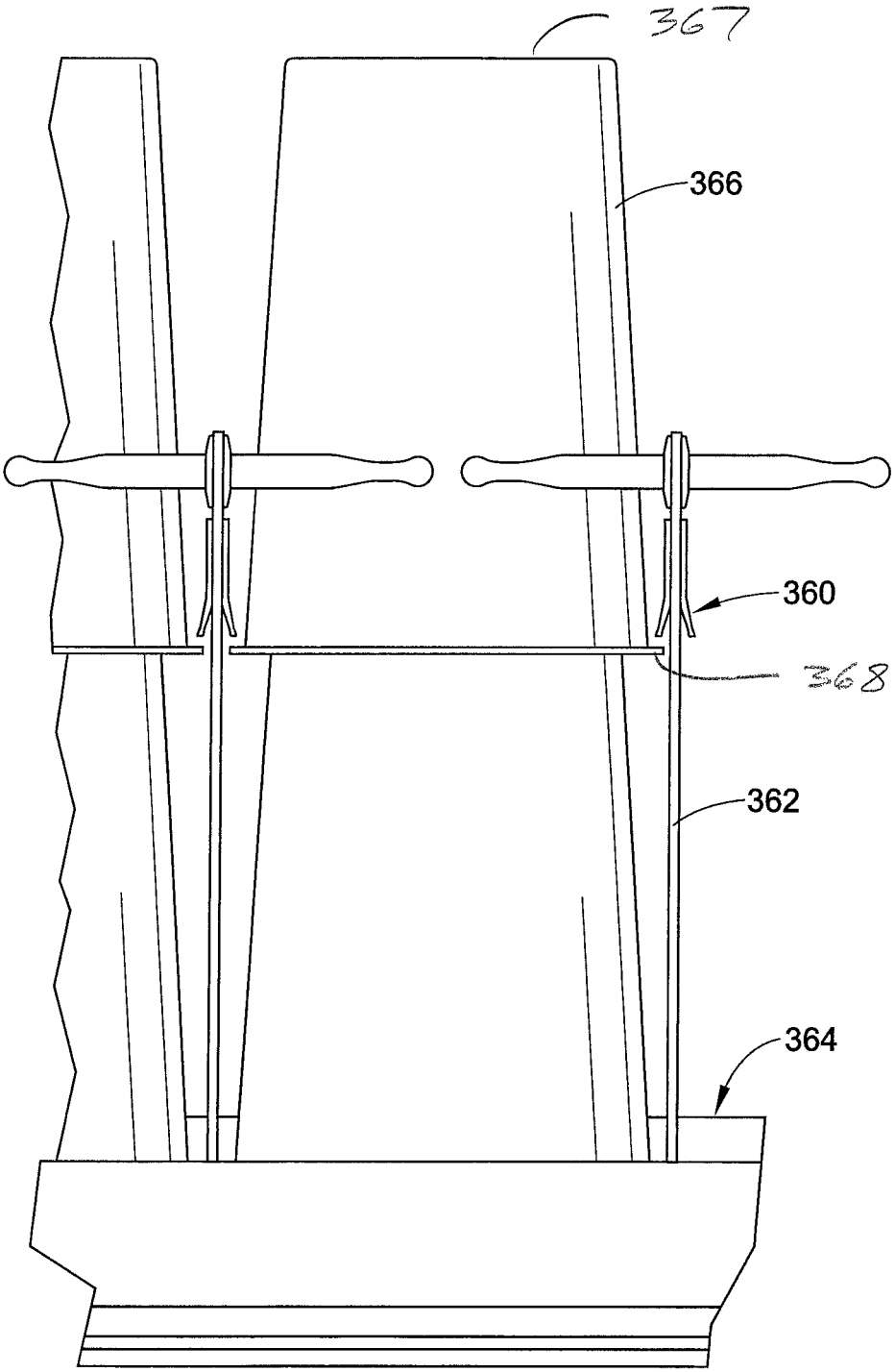
FIG. 11 is an enlarged front elevational view of a portion of the embodiment of FIG. 10.
Figure 12:
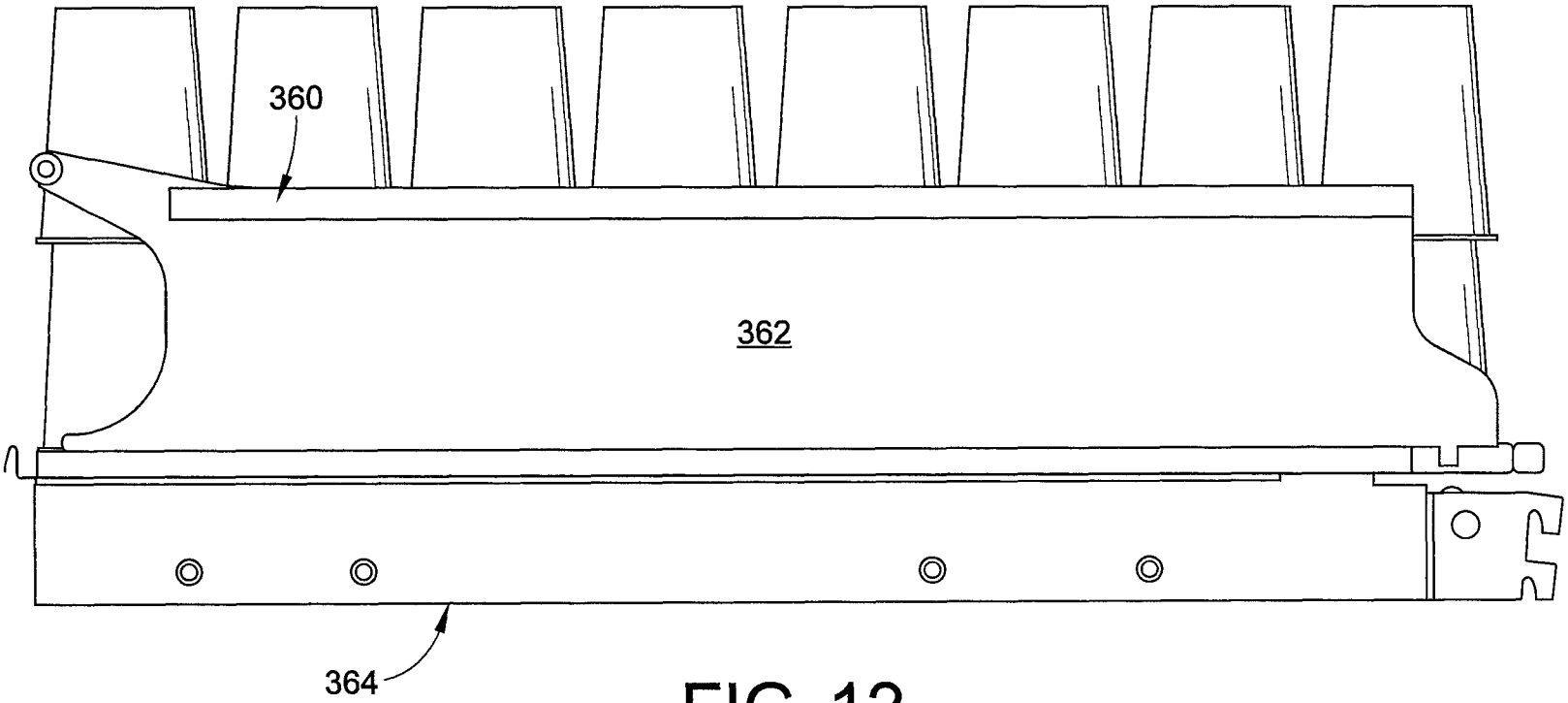
FIG. 12 is a side elevational view of a portion of the embodiment of FIG. 10.
Figure 13:
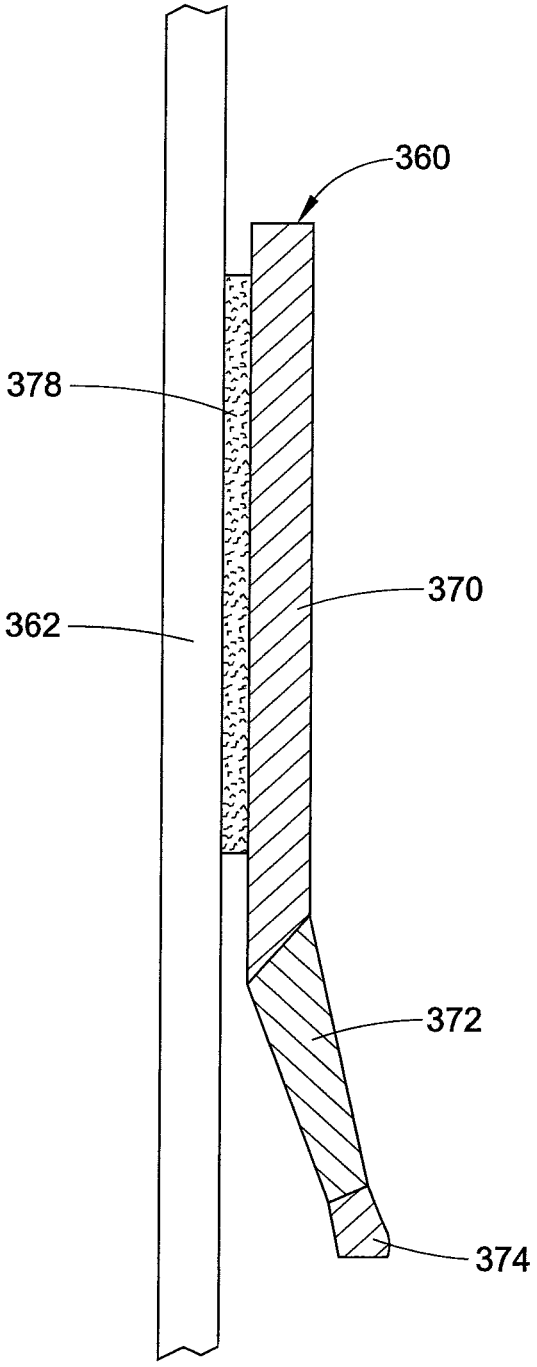
FIG. 13 is a greatly enlarged top plan view of a portion of the embodiment of FIG. 10.

With reference now to FIG. 11, an anti-tip guide 360 is mounted to a divider wall 362 held on a merchandising shelf 364. Product containers 366 are also held on the shelf 364. In one embodiment, the product containers can comprise a planar top surface 367 and a planar base portion 368. It should be apparent from FIG. 11 that the base portion 368 can have a larger diameter than the top portion 367 if so desired. In this embodiment, the base portion 368 protrudes somewhat from the periphery from the container 366 (which can take the form of an upside down truncated cone) adjacent the base portion. With reference now also to FIG. 12, it can be seen that in one embodiment the anti-tip guide extends along a significant portion of the length of the divider 362 from adjacent its rear end to adjacent its front end. With reference now also to FIG. 13, the anti-tip guide comprises a base or first portion 370, an arm or second section 372 and a free end or tip 374. In the design illustrated, both the base and the tip are made of a generally rigid thermoplastic or thermoset material, whereas the arm 372 is made from a relatively flexible thermoplastic or thermoset material. In this way, the tip portion 374 of the anti-tip guide can be flexed away from its normal position and towards a divider wall 376 when it is desired to either add or remove product containers 364 from the shelf and will flex back to its normal position thereafter.

One advantage of the disclosed anti-tip guide is to retard the tipping or angling of stacked product containers such as illustrated in FIG. 11. Any such tipping or angling of the product container 366 is retarded by the presence of the anti-tip guide. This is accomplished by the tip portion 374 contacting the base portion 368 of the product container 366 and preventing or retarding any further angling or tipping of the product container towards one or the other of the dividers 362 or forwards or rearwards. Such an anti-tip guide is particularly advantageous for the second layer of a stacked set of containers because containers in such a second layer or level of containers are more prone to tipping or falling sideways. The anti-tip guide 360 can be mounted to the divider wall 362 via a layer of adhesive 378 if so desired.

It should also be appreciated that, while a single anti-tip guide 360 is illustrated as being mounted to a divider, more than one anti-tip guide may be advantageous in situations where product containers are stacked three high on a subjacent support surface, such as a shelf. While one configuration of an anti-tip guide has been illustrated other configurations are also contemplated. For example, the anti-tip guide can have two or four portions or sections. Also, the anti-tip guide could have non-planar sections or portions if so desired. Further, in another embodiment, the third portion of the anti-tip guide could comprise resilient material instead of the second portion.

Figure 14:
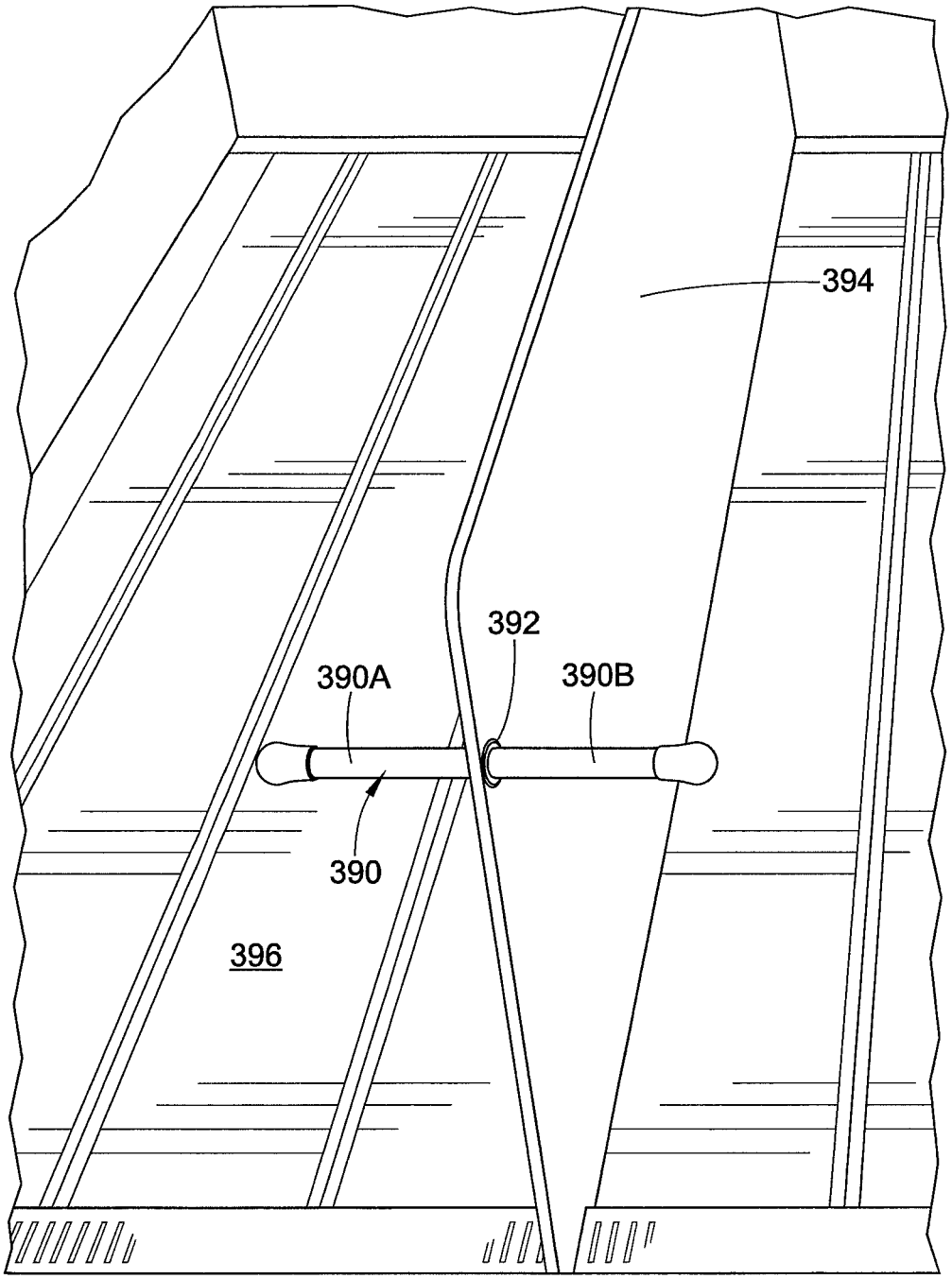
FIG. 14 is a perspective view of another embodiment of a product merchandiser according to the present disclosure.

With reference now to FIG. 14, disclosed is a further embodiment of a movable retainer. In this embodiment, a spring-like member 390 is pushed through an aperture 392 in a divider 394 so that about one half of the member 390, which can comprise two sections, namely sections 390A, 390B is located on a respective side of the divider 394. Each half of the spring-like member can pivot or flex out of the way when access is desired to product being retained behind that member on a shelf 396 and will naturally flex back into its home position when it is no longer being pushed away from its normal orientation.

It should be appreciated that the anti-tip guide needs to be correctly placed on the divider so as to be located a short distance above the base portion of the product container, which is meant to be retarded from tipping. Thus, the location of the anti-tip guide will depend, to a great extent, on the height of the base layer of product containers and a second layer or further layer of product containers stacked atop the base layer, so that the anti-tip guide can fulfill its function. For example, in FIG. 11, the tip portion of the anti-tip guide can be located at approximately 0.2 to 0.5 inches above the upper surface of the base portion 368 of the product container 366.

While FIG. 12 shows a unitary anti-tip guide which extends generally the entire length of the divider 362, it should be appreciated that a set or series of spaced aligned anti-tip guides could also be provided should that be considered desirable. Further, while one embodiment of an anti-tip guide is illustrated in FIG. 13, it should be apparent that other embodiments could also be employed.

Figure 15:
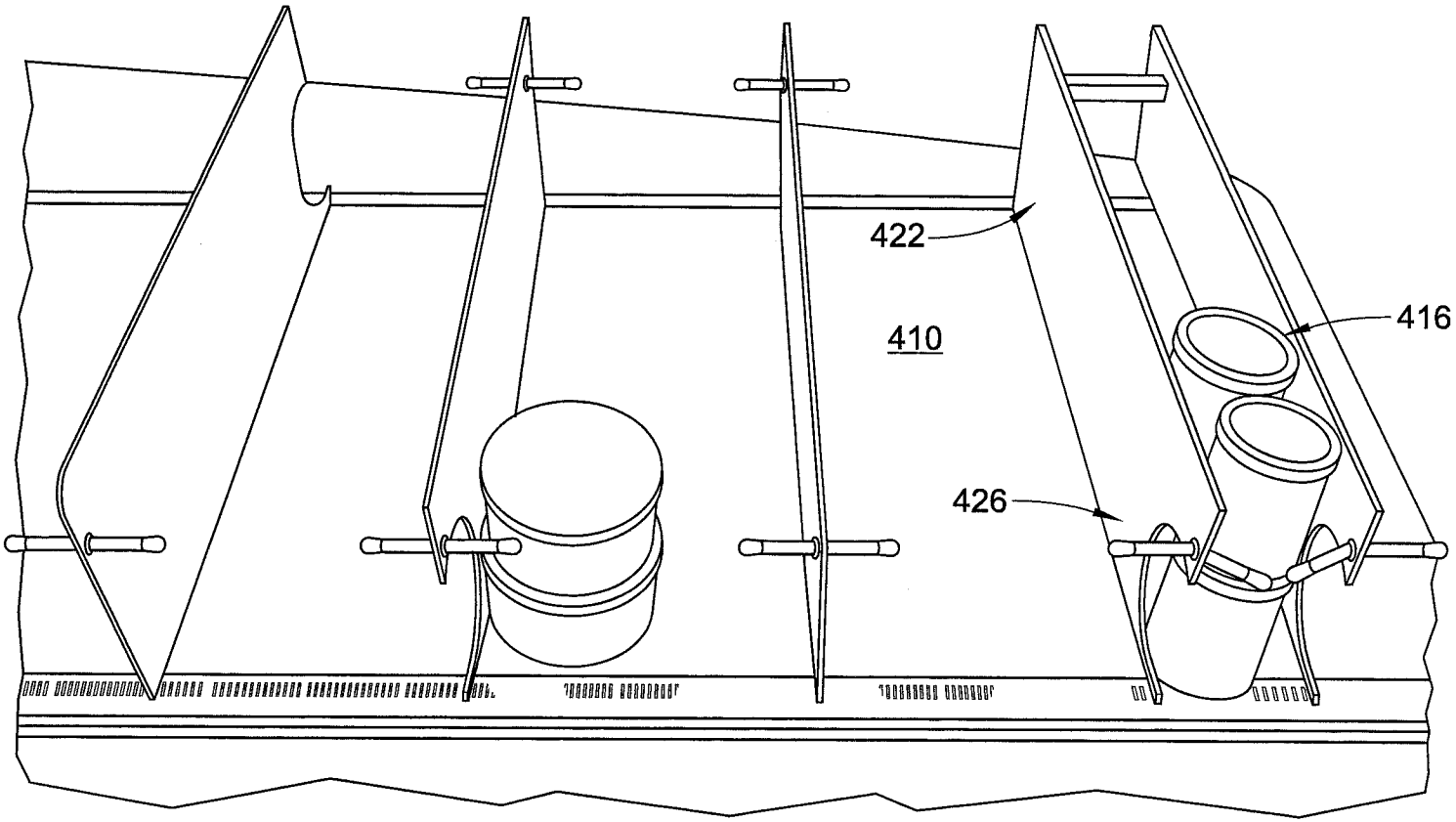
FIG. 15 is a perspective view of still another embodiment of a product merchandiser according to the present disclosure.

With reference now to FIG. 15, there is disclosed a further design of a movable retainer. In this design, a shelf 410 is provided with a plurality of dividers 422 for organizing product containers 416 into columns which may be double stacked as illustrated. The shelf 410 is gravity fed so that the containers will slide forward on the shelf. In order to prevent the containers from falling off the shelf, there is provided a movable retainer 424 in front of the upper level of product. Not illustrated is a fence or retainer to retard the lower level of product from falling off the shelf. The moderate flexing of the movable retainer 424 in its normal "hold" position is illustrated in FIG. 15.

The movable retainers illustrated in FIGS. 10-15 are advantageous from the perspective that they can flex not only forwards but also rearwards because they are oriented generally normal to a plane of the divider to which they are mounted. Furthermore, they can also flex up and down. Such a design is useful in order to allow a potential customer to access product in the lower layer of product in the double stack arrangement illustrated. This is in contrast to prior designs in which retaining fingers only generally flex forward, flexed rearward with some difficulty and did not have the capability of flexing up or down and certainly not both up and down. Therefore, such designs made it difficult, if not impossible, to access product on a lower layer or level of product held on a shelf and located behind a retaining wall, such as is commonly used in product merchandising in forward feed systems to prevent the product from falling off the shelf. A retaining arm with generally universal flexing ability in relation to the divider to which it is attached is greatly advantageous in terms of allowing access to the shelf on which it is located.

Figure 16:
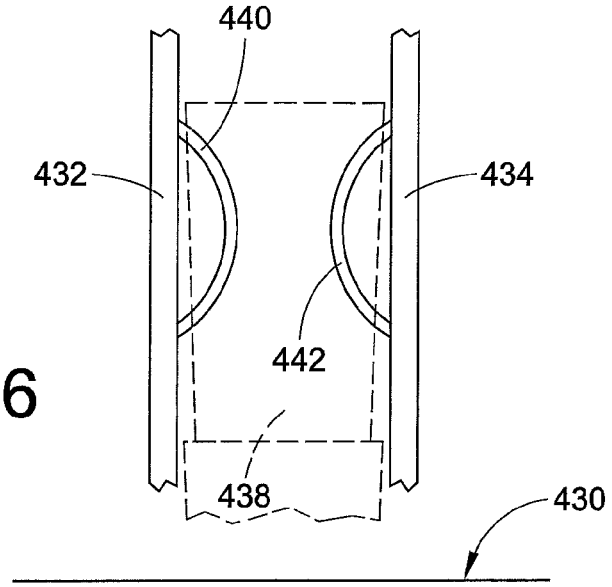
FIG. 16 is a schematic front elevational view of a further embodiment of a product merchandiser according to the present disclosure.

With reference now to FIG. 16, disclosed is a further design of a movable retainer system. In this design, mounted on a shelf 430 are first and second dividers 432 and 434 which are spaced far enough apart so as to accommodate a column of product, including a stacked product container 438. Disposed in front of a forward most one of a column of products are first and second barriers 440 and 442. In this design, the barriers can be flexible, tube-like, generally C-shaped members which are mounted in a vertical orientation adjacent the front end of each respective barrier. In other words, both ends of each barrier are secured to the same divider and each barrier extends vertically. In this design, the barriers can flex out of the way in order to allow withdrawal of a product container 438 and can flex back once such removal has been accomplished. Further, the barriers can flex backwardly to restock product on the shelf. It should be appreciated that the shelf could be a double layer shelf with the first and second barriers 440 and 442 located in front of an upper layer of product, with the lower layer of product being retained behind a front retaining wall or fence, as is known in the art. Alternatively, such barriers could be positioned in front of each layer of product held on a shelf.

Figure 17:
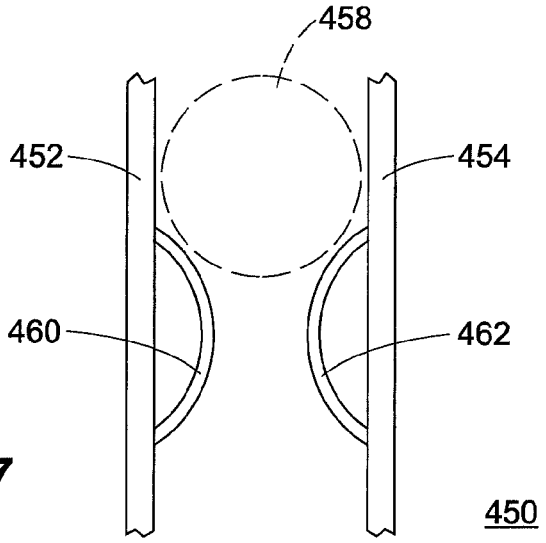
FIG. 17 is a schematic top plan view of yet another embodiment of a product merchandiser according to the present disclosure.

With reference now to FIG. 17, there is disclosed a shelf 450 on which are mounted a pair of spaced dividers 452 and 454. Also held on the shelf 450 are a plurality of product containers 458, only one of which is illustrated. Disposed in front of the forward most product on the shelf are first and second barriers 460 and 462. These barriers are horizontally oriented, in contrast to the barriers illustrated in FIG. 17. In one embodiment, they can be generally C-shaped in design and can be made from a flexible tube-like material such that the barriers can flex out of the way when needed in order to allow access to a product container 458 and will resiliently spring back to their normal position when no longer being interfered with. It should be appreciated that the product 458 is illustrated in FIG. 17 can be an upper layer of product, but could equally be a lower layer.

Figure 18:
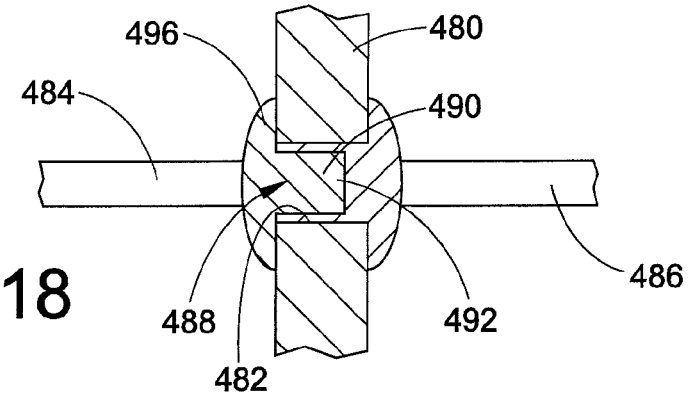
FIG. 18 is an enlarged cross sectional view partially broken away of a movable retainer system for product merchandisers according to an additional embodiment of the present disclosure.

With reference to FIG. 18, there is disclosed a divider 480 which contains an aperture 482. Disposed on a left side of the divider or barrier 480 is a first finger 484 and disposed on the right side is a second finger 486. An interconnect 488 between the fingers extends through the aperture 482. The interconnect can comprise a protrusion 490 extending from the first finger 484 and a socket 492 defined in the second finger 486. In this way, the first and second fingers 484 and 486 can be snapped to each other on respective sides of the divider 480. Covering the aperture 482 on a respective side of the divider 480 is a respective base 496 of the first and second fingers 484 and 486. In this embodiment, the base 496 is of one piece with the respective finger 484 and 486. The bases and fingers can be made from a suitable thermoplastic material which has inherent resiliency allowing the interconnect 488 to function, to either secure the retaining construction defined by the first and second fingers to the divider 480 or remove it from the divider should that become necessary.

The product merchandiser illustrated herein allows shelving to be stacked closely together as withdrawal of the containers does not involve much upward movement of the containers to clear a barrier located in front of either an upper or lower level of containers. Instead, the containers can be withdrawn in a generally horizontal direction. This allows the product density for the merchant to be increased, which is very desirable, as shelves can be stacked more closely together.

Figure 19:
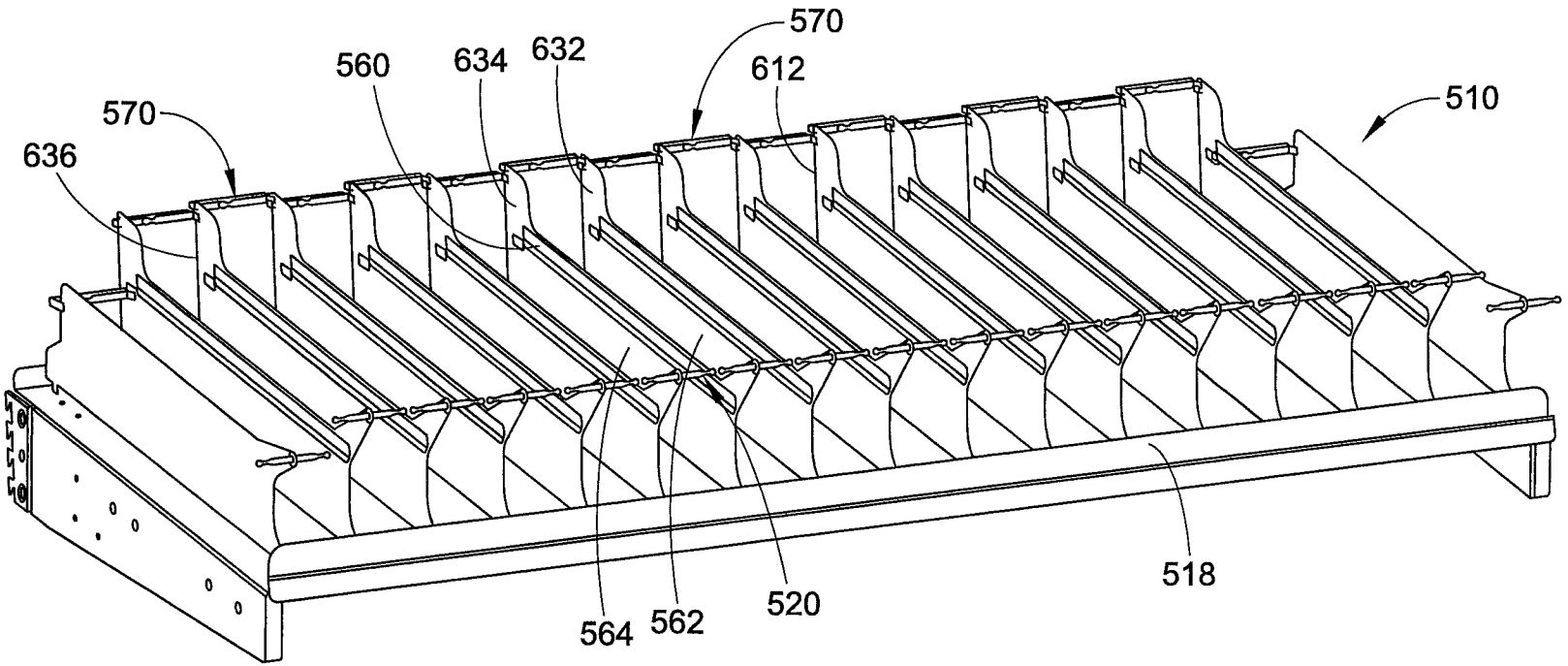
FIG. 19 is a perspective view of another embodiment of a product merchandiser according to the present disclosure.

With reference now to FIG. 19, disclosed is a merchandising shelf 510 including a plurality of dividers which divide the merchandise into columns. A gravity fed merchandising system is disclosed in which a foremost product in a column of products is, on a lower level, restrained from falling off the shelf via a front fence 518. An upper level of product in the column of products is restrained from falling off the shelf by a movable retainer assembly 520.

With continued reference to FIG. 19, it can be seen that product guides 560 are mounted to a pair of dividers 562 and 564. The product guides can, if desired, extend substantially the length of the respective divider. Mounted to each pair of dividers can be a connector assembly 570.

Figure 20:
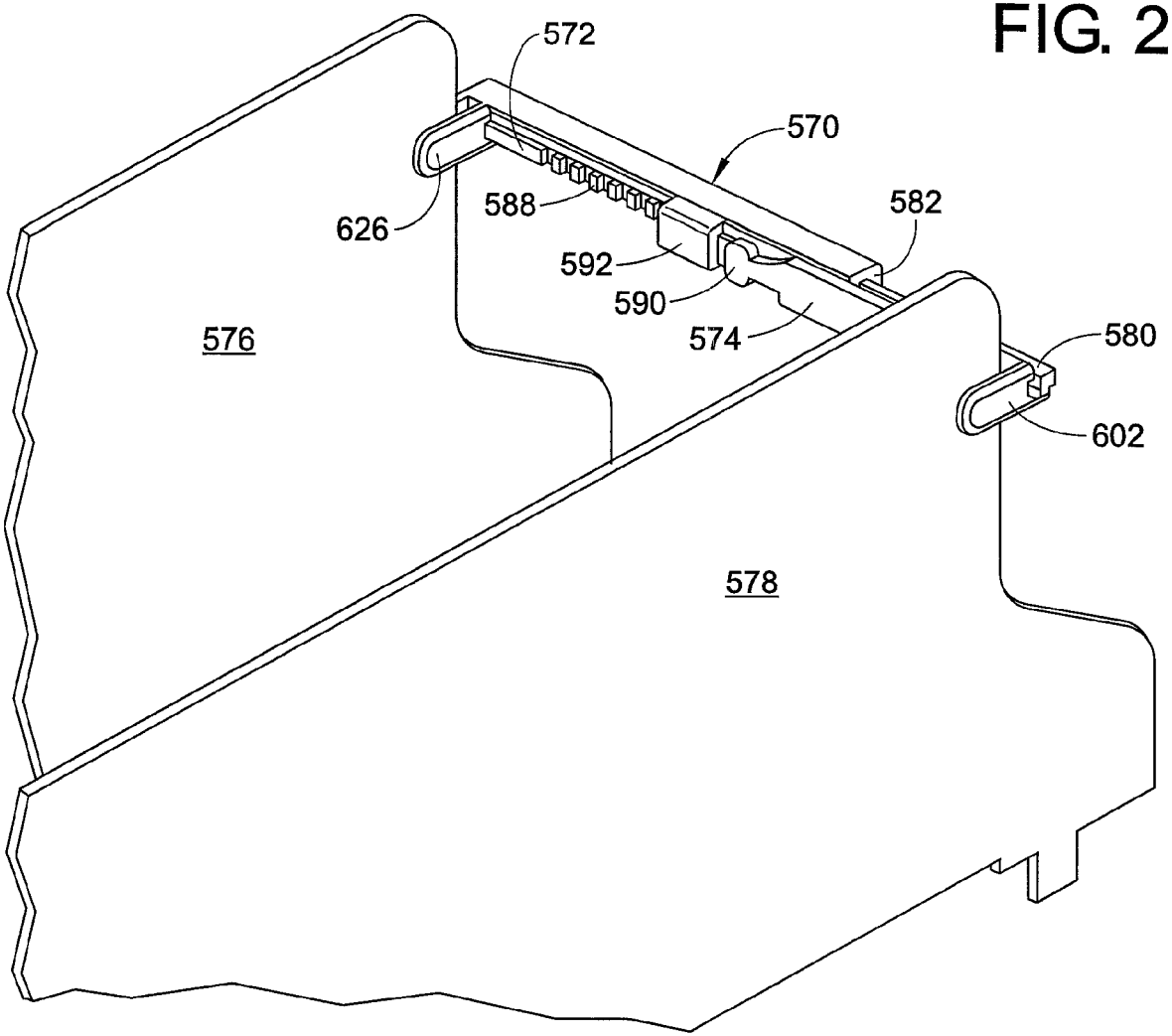
FIG. 20 is an enlarged perspective view of another embodiment of a merchandiser.
Figure 21:
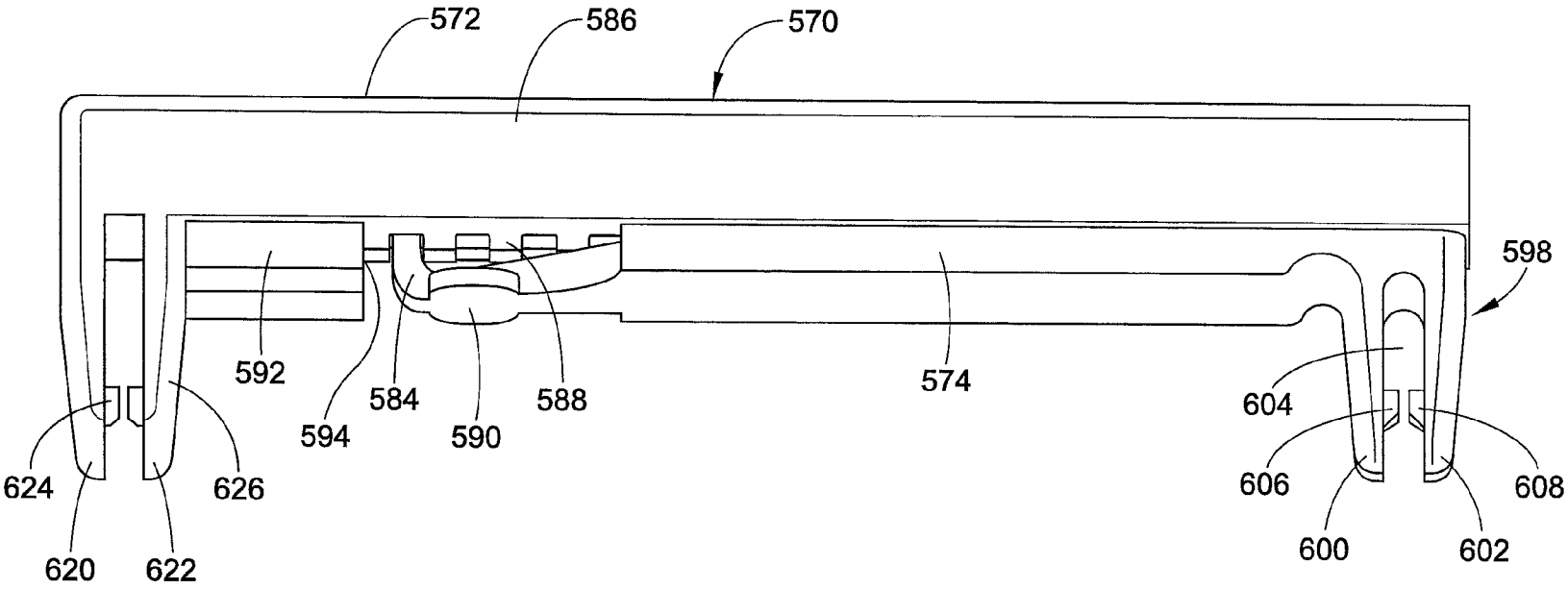
FIG. 21 is an enlarged perspective view of a connector assembly according to the present disclosure.

With reference now to FIG. 20 the connector assembly can include a first section 572 and a second section 574. Each section can be connected to a respective divider 576 and 578. As is evident from the comparison between FIGS. 20 and 21, the connector assembly second section 574 is slidably mounted to the connector assembly first section 572. More particularly, a track 580 of the second section 574 rides in a slot 582 of the first section 572. Thus, the connector assembly can be widened or narrowed as may be necessary in order to accommodate a width or spacing between a pair of adjacent dividers. Once set to a particular width, the connector assembly stays at that width because the connector assembly second section 574 includes a projection 584 which engages in a slot 586 defined between a pair of adjacent teeth 588 of the connector assembly first section 572.

Because the connector assembly second section 574 is made from a suitable resilient material, the projection 584 can be selectively disengaged from the teeth 588 of the first section 572. This can be accomplished by grasping an enlarged portion 590 of the second section 574. Located on a distal end of the second section 574 is a cover 592 which is connected to a remainder of the second section via an arm 594. The purpose for the cover 592 is to encase or enclose the several teeth 488 defined on a proximal portion of the connector assembly first section 572 so that dirt does not accumulate in the slots 486 between the teeth 488.

The connector assembly second section 574 also includes an attachment portion 598 which comprises a first arm 600 and, spaced therefrom, a second arm 602. The two arms defined between them a gap or slot 604. Extending into the slot 604 are respective protrusions 606 and 608 that are mounted to the respective arms 600 and 602. With reference again to FIG. 19, the protrusions can extend into bores 612 defined on each of the dividers. In this way, the connector assembly 570 is mounted to a pair of adjacent dividers. It should be apparent that the connector assembly first section 572 has similar first and second arms 620 and 622 in protrusions 624 and 626.

The connector assemblies 570 can be mounted to suitable dividers, such as the dividers shown in FIG. 20, or the dividers shown in FIG. 19. In the latter case, it can be seen that the connectors are staggered so that they do not interfere with each other. More particularly, the connectors are secured to respective wings 632 and 634 of the respective dividers 562 and 564. Alternatively, the connector assemblies 570 can be secured through slots 636 in the dividers.

It should be appreciated from FIG. 19 that the connector assemblies 570 are located well above a lower end of the pair of dividers illustrated in FIG. 19. More particularly, the connector assemblies can be mounted adjacent an upper end of a respective divider, is so desired. FIG. 19 illustrates that the connector assemblies can be mounted at varying heights in relation to a divider. It is advantageous to position the connector assemblies well away from the bottom ends of the dividers because the bottom ends are likely to be mounted to a support surface, whereas the upper ends of the dividers are left relatively free to move sideways even though the bottom ends of the dividers are constrained.

The purpose for providing a connector assembly 570 for connecting together a pair of adjacent dividers is to retard a tendency of the dividers to flex away from each other because any such tendency would hinder the usefulness of the product guides 560. The connector assembly may also prove useful in retaining or keeping stacked product on a slide out shelf when the shelf is returned from a restocking position to a merchandising position, i.e., the shelf is slid back to the merchandising position. The purpose for the product guides is to prevent a second layer of product containers stacked atop a first layer of product containers from tipping away from a horizontal plane, as noted above. While connector assemblies 570 are illustrated as being attached, mounted or connected to respective rear ends of the dividers, the connector assemblies could conceivably be mounted to the respective dividers at other locations along the length of the dividers. This would depend to some extent on the product which is being vended by the shelf.

In the embodiments disclosed herein, the several versions of the movable retainer each extend at least partially across a width of a channel defined in the support member between a pair of facing dividers or side walls. The retainer can flex outwardly to allow product to be withdrawn from the shelf by a consumer. The several versions allow the retainer to move from a first position retarding forward movement of merchandise in a channel to a second position allowing such movement. Some versions allow movement to a third position enabling a restocking of products on the shelf. The movement of the retainer allows food containers and like merchandise to be withdrawn from a front end of a channel or restocked in the channel.

The several varieties of product merchandisers illustrated herein allow shelving to be stacked more closely together as the withdrawal of product containers does not involved much upward movement of the containers in order to clear a front fence or barrier. Instead, the containers can simply be titled and then withdrawn from the merchandising structure in a generally horizontal direction. This allows the merchant to increase the product density in the store which is very desirable as shelves can be stacked more closely together and more products can be offered to potential customers.

The present disclosure has been described with reference to several embodiments. Obviously, modifications and alterations will occur to others upon the reading and understanding of the preceding detailed description. It is intended that the present disclosure be construed as including all such modifications and alterations insofar as they come within the scope of the appended claims or the equivalents thereof.

What is claimed is:

1. A merchandising assembly including an associated support member for supporting at least one associated object for display and/or dispensing, and a pair of dividers mounted generally perpendicular to said associated support member and spaced from each other, the pair of spaced dividers defining between them a longitudinal pathway along which the associated at least one object can travel from a rear position to a front position on the associated support member;

an anti-tip guide comprising:

a first section mounted to one of said pair of dividers and extending in a plane oriented parallel to a plane of the one of the pair of dividers;

a second section connected to and protruding away from the plane of said first section at a tapered angle at least partially into the longitudinal pathway defined between the pair of spaced dividers; wherein the first and second sections define a cross section of the anti-tip guide, wherein the cross section of the anti-tip guide is continuous along the entire length of the anti-tip guide;

wherein the anti-tip guide is elongated and extends along more than half of a length of the at least one of the pair of dividers and wherein the anti-tip guide extends towards the associated support member;

wherein said second section comprises a material which is more resilient than is a material of said first section; and, wherein the first section and second section are coextensive along more than half the length of the at least one of the pair of dividers;

wherein the anti-tip guide is configured to prevent the tipping or angling of stacked associated objects stored in a corresponding longitudinal pathway.

2. The merchandising assembly of claim 1 further comprising an adhesive layer adapted to secure the anti-tip guide first section to the divider.

3. The merchandising assembly of claim 1, wherein a pair of anti-tip guides are provided, one mounted to each of the pair of dividers.

4. The merchandising assembly of claim 1 wherein the first section is planar.

5. The merchandising assembly of claim 3 wherein the second section is planar.

6. The merchandising assembly of claim 3 wherein the second section is oriented at an acute angle in relation to a plane of the first section.

7. The merchandising assembly of claim 1 further comprising a third section connected to and extending away from the second section.

8. The merchandising assembly of claim 7 further wherein the third section is planar.

9. The merchandising assembly of claim 7 wherein the third section extends in a common plane with the second section thereof.

10. The merchandising assembly of claim 7 wherein the first, second, and third sections are of one piece.

11. The anti-tip guide of claim 1, wherein the second section includes a proximal portion connected to the first section and a distal portion opposite the proximal portion, the distal portion having an edge extending in a common direction with the longitudinal pathway.

* * * * *